US008978566B2

(12) United States Patent
Hasegawa et al.

(10) Patent No.: US 8,978,566 B2
(45) Date of Patent: Mar. 17, 2015

(54) SEWING MACHINE

(71) Applicants: Katsuhisa Hasegawa, Kasugai (JP); Midori Magara, Nagoya (JP); Kiyokazu Sekine, Kuwana (JP); Harumi Kobayashi, Nagoya (JP)

(72) Inventors: Katsuhisa Hasegawa, Kasugai (JP); Midori Magara, Nagoya (JP); Kiyokazu Sekine, Kuwana (JP); Harumi Kobayashi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 14/223,007

(22) Filed: Mar. 24, 2014

(65) Prior Publication Data

US 2014/0290550 A1 Oct. 2, 2014

(30) Foreign Application Priority Data

Mar. 28, 2013 (JP) ..... 2013-069182

(51) Int. Cl.

| | |
|---|---|
| ***D05B 19/00*** | (2006.01) |
| ***D05B 19/12*** | (2006.01) |
| ***D05B 37/08*** | (2006.01) |
| ***D05C 9/06*** | (2006.01) |

(52) U.S. Cl.

CPC ..... *D05B 19/12* (2013.01); *D05B 37/08* (2013.01); *D05C 9/06* (2013.01)

USPC ..... 112/470.05

(58) Field of Classification Search

USPC ..... 112/470.05, 470.06, 470.09, 98, 80.04, 112/80.23, 80.4, 102.5, 220, 249

See application file for complete search history.

(56) References Cited

U.S. PATENT DOCUMENTS

| | | | | |
|---|---|---|---|---|
| 1,906,087 | A * | 4/1933 | Parkes | 112/241 |
| 4,455,956 | A * | 6/1984 | Yamamoto et al. | 112/274 |
| 6,047,653 | A * | 4/2000 | Cash | 112/199 |
| 7,620,472 | B2 * | 11/2009 | Hamajima | 700/136 |
| 8,272,341 | B2 | 9/2012 | König et al. | |

* cited by examiner

*Primary Examiner* — Tejash Patel
(74) *Attorney, Agent, or Firm* — Oliff PLC

(57) ABSTRACT

A sewing machine may comprise a needle bar driving mechanism, a cutting needle rotation mechanism, and an embroidery frame movement mechanism configured to move an embroidery frame comprising a protruding portion. A cam member may be fixed to the needle bar and comprise a plurality of cams. A processor of the sewing machine may set a height of the needle bar to a specific position from a plurality of positions. Each of the plurality of positions may represent that each of the plurality of cams is able to contact with the protruding portion. The processor may instruct the needle bar driving mechanism to move the needle bar to the specific position and instruct the embroidery frame movement mechanism to move the embroidery frame to a position where the protruding portion is able to contact with one of the plurality of cams.

8 Claims, 21 Drawing Sheets

FIG. 7

100

| NEEDLE DROP NUMBER N | X COORDINATE DATA | Y COORDINATE DATA | CUTTING NEEDLE ANGLE DATA (DEGREES) |
|---|---|---|---|
| 1 | x1 | y1 | 0 |
| 2 | x2 | y2 | 45 |
| 3 | x3 | y3 | 135 |
| 4 | x4 | y4 | 90 |
| · | · | · | · |
| · | · | · | · |
| · | · | · | · |
| CUT_END | x | y | 0 |

FIG. 8

210

| CUTTING NEEDLE ANGLE DIFFERENCE DATA (DEGREES) | CURRENT CUTTING NEEDLE ANGLE 0 DEGREES | | | CURRENT CUTTING NEEDLE ANGLE 45 DEGREES | | | CURRENT CUTTING NEEDLE ANGLE 90 DEGREES | | | CURRENT CUTTING NEEDLE ANGLE 135 DEGREES | | |
|---|---|---|---|---|---|---|---|---|---|---|---|---|
| | P=1 | P=2 | P=3 | P=1 | P=2 | P=3 | P=1 | P=2 | P=3 | P=1 | P=2 | P=3 |
| 45 | 2 | – | – | 1 | – | – | 4 | – | – | 3 | – | – |
| 90 | 2 | 1 | – | 1 | 4 | – | 4 | 3 | – | 3 | 2 | – |
| 135 | 2 | 1 | 4 | 1 | 4 | 3 | 4 | 3 | 2 | 3 | 2 | 1 |

FIG. 9

220

| CAM NUMBER M | DRIVE SHAFT STOP ANGLE DATA |
|---|---|
| 1 | A1 |
| 2 | A2 |
| 3 | A3 |
| 4 | A4 |

FIG. 10

230

| | | CURRENT CAM NUMBER M | | | |
|---|---|---|---|---|---|
| | | 1 | 2 | 3 | 4 |
| CAM NUMBER M FOR NEXT CONTACT | 1 | – | A21 | A31 | A41 |
| | 2 | A12 | – | A32 | A42 |
| | 3 | A13 | A23 | – | A43 |
| | 4 | A14 | A24 | A34 | – |

FIG. 19

300

| CUTTING NEEDLE ANGLE DATA (DEGREES) | GUIDE PORTION NUMBER K | X COORDINATE DATA | Y COORDINATE DATA |
|---|---|---|---|
| 0 | 1 | u1 | v1 |
| 45 | 2 | u2 | v2 |
| 90 | 3 | u3 | v3 |
| 135 | 4 | u4 | v4 |

SEWING MACHINE

CROSS-REFERENCE TO RELATED APPLICATION

This application claims priority to Japanese Patent Application No. 2013-069182, filed on Mar. 28, 2013, the content of which is hereby incorporated by reference.

BACKGROUND

The present disclosure relates to a sewing machine.

A sewing machine is known that causes a cutting needle attached to a needle bar to automatically rotate. The sewing machine includes a rotation mechanism, which is provided on the cutting needle attached to the needle bar, and a presser bar. The presser bar includes a concave portion that is indented toward an axial line of the presser bar. The rotation mechanism includes a plurality of convex portions that are arranged at equal intervals along the direction of rotation of the cutting needle and that protrude in a direction in which they become separated from the cutting needle. The cutting needle and the plurality of convex portions rotate integrally. The rotation mechanism includes a rotation locking member that locks the rotation of the cutting needle. The rotation locking member locks one of the plurality of convex portions in a position in which it can engage with the concave portion.

When the sewing machine causes the cutting needle to rotate, the needle bar is lowered in a position in which one of the plurality of convex portions is in a position in which it can engage with the concave portion. After that, the sewing machine moves the needle bar in the horizontal direction. The convex portion that engages with the concave portion rotates around the axial line of the needle bar along with the movement of the needle bar. By this rotation, the sewing machine can automatically cause the cutting needle to rotate.

SUMMARY

However, with the above-described sewing machine, in an operation to cut a work cloth using the cutting needle by moving the needle bar up and down, it is necessary that the convex portion does not come into contact with the concave portion and a specific gap is provided between the convex portion and the concave portion. As a result, there is a possibility that the cutting needle may not rotate smoothly even if the needle bar is moved in the horizontal direction, due to variations in the dimensions of the above-described members and variations arising in the assembly of each of the members.

Various embodiments of the general principles described herein provide a sewing machine that each enable rotating a cutting needle stably and automatically.

Various embodiments herein provide a sewing machine that includes a needle bar driving mechanism, an embroidery frame movement mechanism, a cutting needle rotation mechanism, a processor, and a memory. The needle bar driving mechanism is configured to move a needle bar in a first direction. The embroidery frame movement mechanism is configured to receive an embroidery frame, and is configured to move the embroidery frame along a second direction crossing the first direction. The embroidery frame comprises a protruding portion that protrudes outward from the embroidery frame. The cutting needle rotation mechanism comprises a cutting needle, a cam member, and a support mechanism. The cam member has a fixed cutting needle and comprises a plurality of cams arranged along the first direction and rotatable around the first direction. Each of the plurality of cams comprises a surface portion. The surface portion comprises a width along the first direction and is arranged in different positions along the first direction. The support mechanism is configured to support the cam member on the needle bar rotatably. The memory is configured to store computer-readable instructions that cause the sewing machine to set a height of the needle bar to a specific position from a plurality of positions, each of the plurality of positions representing that each of the plurality of cams is able to contact with the protruding portion, instruct the needle bar driving mechanism to move the needle bar to the specific position, and instruct the embroidery frame movement mechanism to move the embroidery frame along the second direction to a predetermined position where the protruding portion is able to contact with one of the plurality of cams.

Embodiments also provide a sewing machine that includes a needle bar driving mechanism, an embroidery frame movement mechanism, a cutting needle rotation mechanism, a processor, and a memory. The needle bar driving mechanism is configured to move a needle bar in a first direction. The embroidery frame movement mechanism is configured to receive an embroidery frame and is configured to move the embroidery frame along a second direction and a third direction crossing the first direction. The embroidery frame comprises a plurality of protruding portions. Each of the plurality of the protruding portions is disposed on the embroidery frame along the third direction. Each of the plurality of the protruding portions protrudes outward from the embroidery frame. The cutting needle rotation mechanism comprises a cutting needle, a cam member, and a support mechanism. The cam member has a fixed cutting needle and comprises a plurality of cams arranged along the first direction and rotatable around the first direction. Each of the plurality of cams comprises a surface portion that comprises a width along the first direction and arranged in different positions along the first direction. The support mechanism is configured to support the cam member on the needle bar rotatably. The memory is configured to store computer-readable instruction that causes the sewing machine to instruct the embroidery frame movement mechanism to move the embroidery frame along the second direction and the third direction to a specific position where one of the plurality of protruding portions is able to contact with one of the plurality of cams.

Embodiments also provide a sewing machine that a needle bar driving mechanism, a cutting needle rotation mechanism, an embroidery frame movement mechanism, a processor, and a memory. The needle bar driving mechanism is configured to move a needle bar in a first direction. The cutting needle rotation mechanism comprises a cutting needle, a base member, and a support member. The base member comprises a protruding member that protrudes along a particular direction to be separated from the needle bar. The support member is configured to support the base member on the needle bar rotatably. The embroidery frame movement mechanism is configured to receive an embroidery frame and is configured to move the embroidery frame along a second direction crossing the first direction. The embroidery frame comprises a plurality of guide portions. Each of the plurality of guide portions is configured to engage with the protruding member. The memory is configured to store computer-readable instructions that cause the sewing machine to set a specific position of the embroidery frame to a predetermined position from a plurality of positions, each of the plurality of positions representing that each of the plurality of guide portions is able to engage with the protruding member, instruct the embroidery frame movement mechanism to move the embroidery frame to the specific position, and instruct the needle bar driving mechanism to move the needle bar in the first direction.

BRIEF DESCRIPTION OF THE DRAWINGS

Embodiments will be described below in detail with reference to the accompanying drawings in which:

FIG. 7 is an example of a data configuration diagram of outwork pattern data 100;

FIG. 8 is an example of a data configuration diagram of cam number data 210;

FIG. 9 is an example of a data configuration diagram of drive shaft stop angle data 220;

FIG. 10 is an example of a data configuration diagram of rotation difference amount data 230;

FIG. 19 is an example of a data configuration diagram of guide portion number data 300;

DETAILED DESCRIPTION

Figure 1:
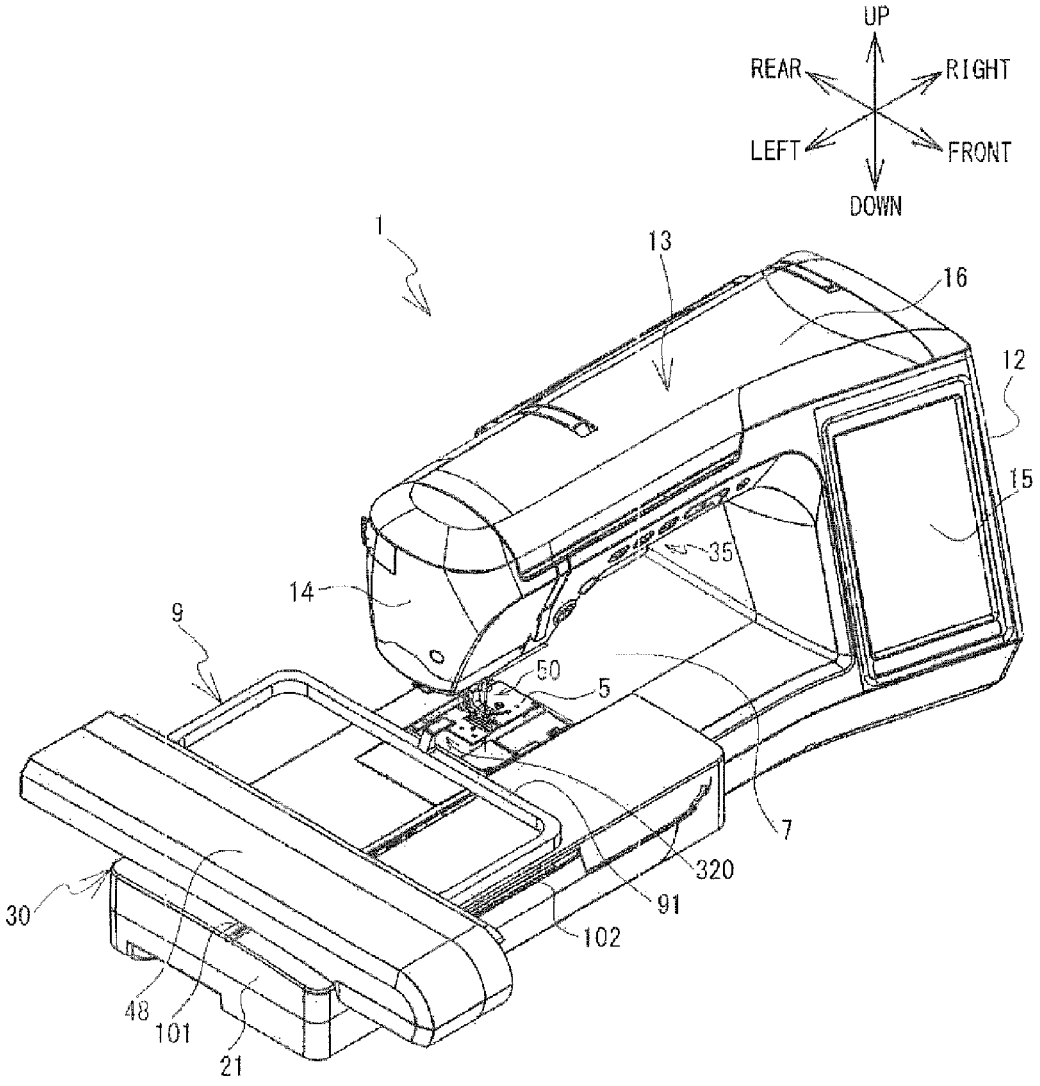
FIG. 1 is an example of a perspective view of a sewing machine 1.

Hereinafter, a sewing machine 1 according to a first embodiment of the present disclosure will be explained with reference to the drawings. The sewing machine 1 performs sewing or cut work on a work cloth (not shown in the drawings). The cut work is an operation to form a pattern on the work cloth by cutting out specific areas of the work cloth.

The configuration of the sewing machine 1 will be explained with reference to FIG. 1 to FIG. 3. The lower right side, the upper left side, the lower left side, the upper right side, the upper side and the lower side in FIG. 1 correspond, respectively, to the front side, the rear side, the left side, the right side, the upper side and the lower side of the sewing machine 1. Further, the left-right direction of the sewing machine 1 is an X direction and the front-rear direction of the sewing machine 1 is a Y direction.

As shown in FIG. 1, the sewing machine 1 is provided with a bed portion 7, a pillar 12, an arm portion 13 and a head portion 14. The bed portion 7 is a base of the sewing machine 1 and extends in the left-right direction. An embroidery frame movement mechanism 30, which will be described later, can be detachably mounted on the bed portion 7. The pillar 12 is provided extending upward from the right end portion of the bed portion 7. The arm portion 13 extends to the left from the top end portion of the pillar 12. The head portion 14 is provided on the leading left end of the arm portion 13. A needle plate 5 is disposed on the top surface of the bed portion 7. A feed dog (not shown in the drawings), a movement mechanism 85 (refer to FIG. 6), a movement motor 80 (refer to FIG. 6) and a shuttle mechanism (not shown in the drawings) are provided inside the bed portion 7 below the needle plate 5. The feed dog moves the work cloth that is placed on the top of the bed portion 7 by a predetermined amount. The movement mechanism 85 drives the feed dog. The movement motor 80 is a pulse motor that drives the movement mechanism 85. The shuttle mechanism is a mechanism that is structured to form stitches in a sewing workpiece, by moving in concert with a sewing needle, when the sewing needle (not shown in the drawings) is attached to the lower end of the needle bar 6 (which will be described later).

A vertically long rectangular liquid crystal display 15 is provided on the front surface of the pillar 12. The liquid crystal display 15 displays images of various items, such as a plurality of types of sewing patterns or cutwork patterns, names of commands to execute various functions, and various messages etc. A transparent touch panel 26 (refer to FIG. 6) is provided on the front surface of the liquid crystal display 15. A user can select or input a desired sewing pattern, a desired cutwork patter or a command to be executed by touching a portion on the touch panel 26 that corresponds to an item displayed on the liquid crystal display 15, using a finger or a dedicated touch pen.

The structure of the arm portion 13 will be explained. Operation switches 35, which include a sewing start switch etc., are provided on the lower portion of the front surface of the arm portion 13. An opening/closing cover 16 is provided on the upper portion of the arm portion 13. FIG. 1 shows a state in which the opening/closing cover 16 is closed. The opening/closing cover 16 is axially supported by a rotating shaft (not shown in the drawings) that extends in the left-right direction. The rotating shaft is provided on the upper rear end portion of the arm portion 13. A thread storage portion (not shown in the drawings) housing a thread spool (not shown in the drawings) that supplies an upper thread (not shown in the drawings) is provided underneath the opening/closing cover 16, that is, inside the arm portion 13. The upper thread that extends from the thread spool is supplied to a sewing needle that is not shown in the drawings, via a threading portion that includes a tensioner, a thread take-up spring and a thread take-up lever etc (that are not shown in the drawings). The tensioner is provided on the head portion 14 and adjusts the thread tension. The thread take-up lever is driven to move reciprocatingly in the up-down direction and pulls up the upper thread. A sewing needle (not shown in the drawings) or a cutting needle rotation mechanism 50 can be selectively attached to the lower end of the needle bar 6 (refer to FIG. 3) that is provided on the lower portion of the head portion 14. The sewing needle is attached when the sewing machine 1 performs the sewing operation, and the cutting needle rotation mechanism 50 is attached when the sewing machine 1 performs outwork. The needle bar 6 is driven to move in the up-down direction by a needle bar up-and-down movement mechanism 84 (refer to FIG. 6) that is provided inside the head portion 14. The needle bar up-and-down movement mechanism 84 is driven by a drive shaft 72 (refer to FIG. 6) that is rotated by a sewing machine motor 79 (refer to FIG. 6). When the drive shaft 72 makes one rotation, the needle bar 6 moves reciprocatingly once in the up-down direction. In other words, the rotation angle of the drive shaft 72 and the position (height) of the needle bar 6 in the up-down direction correspond to each other, and the position of the needle bar 6 in the up-down direction can be determined by detecting the rotation angle of the drive shaft 72. Further, due to a needle bar swinging mechanism 86 (refer to FIG. 6) that is provided inside the head portion 14, the needle bar 6 can swing in a direction that is orthogonal to a direction (the front-rear direction) in which the work cloth is fed by the feed dog (not shown in the drawings). The needle bar swinging mechanism 86 is driven by a swinging motor 81 (refer to FIG. 6).

Figure 2:
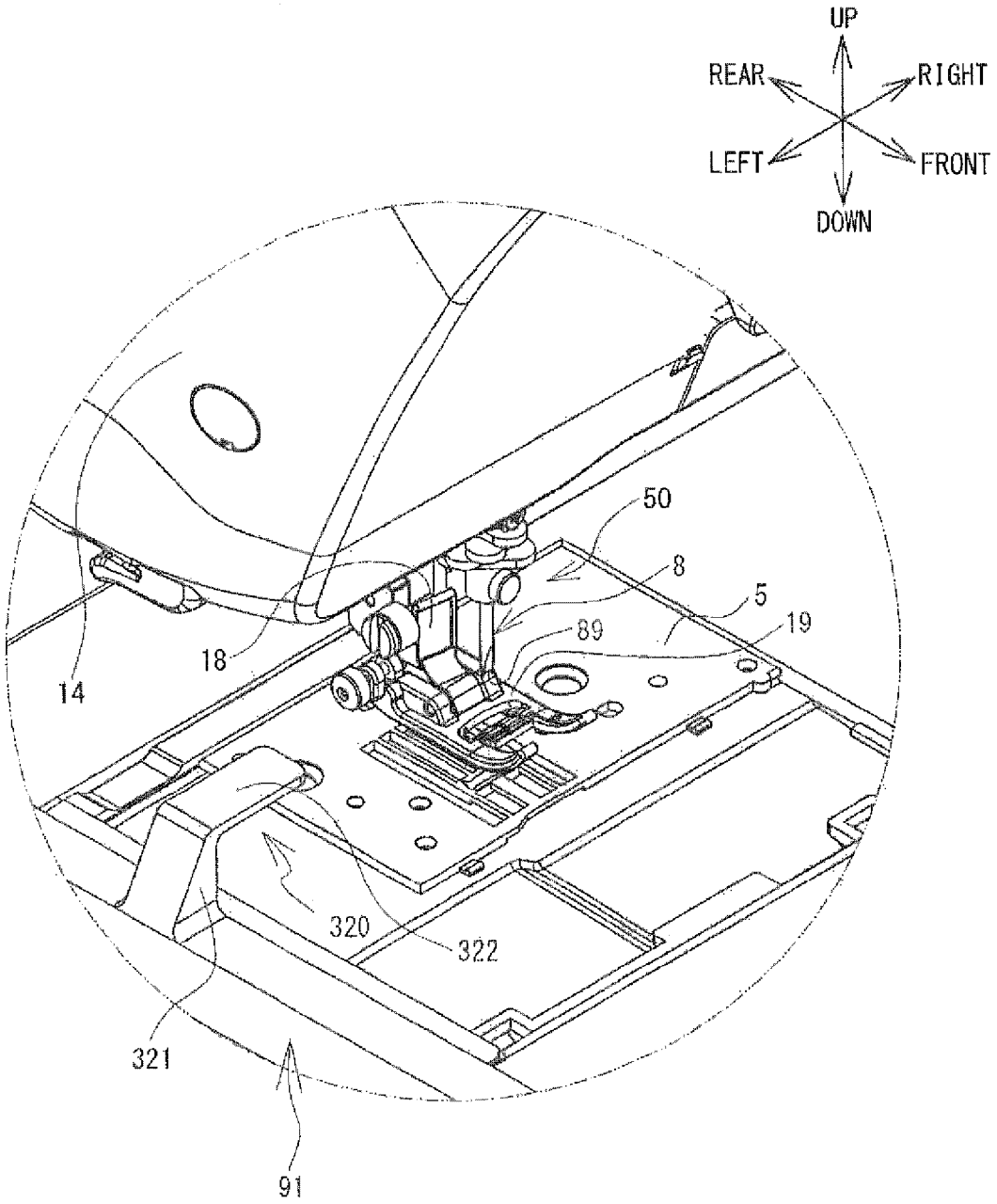
FIG. 2 is an example of an enlarged perspective view of the vicinity of a cutting needle rotation mechanism 50.
Figure 3:
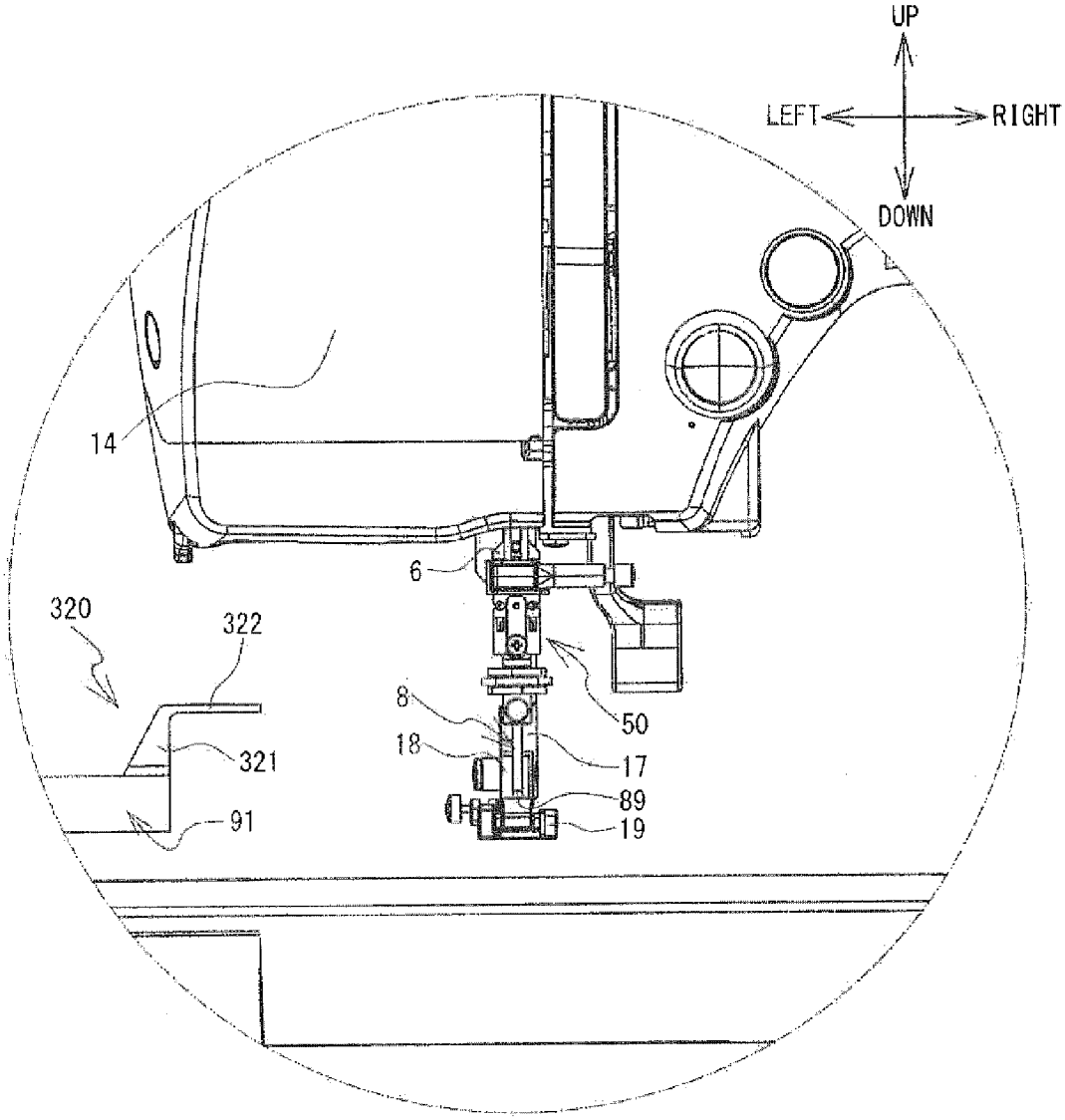
FIG. 3 is an example of an enlarged right side view of the vicinity of the cutting needle rotation mechanism 50.

As shown in FIG. 2 and FIG. 3, the cutting needle rotation mechanism 50 is detachably attached to the lower end of the needle bar 6. The cutting needle rotation mechanism 50 rotatably supports a cutting needle 8 that extends in the up-down direction. When the cutting needle rotation mechanism 50 is attached to the needle bar 6, the needle bar 6 moves to a position that is highest in a movement range of the needle bar 6 in the up-down direction (hereinafter also referred to as a top needle position). When the cutting needle 8 is used to perform cutwork, a blade portion 89 of the cutting needle 8 is moved from the top side to the bottom side of the work cloth (not shown in the drawings) and forms a specific cut in the work cloth that depends on the orientation of the blade portion 89. The cutting needle rotation mechanism 50 will be explained in more detail later.

A presser bar 17 (refer to FIG. 3) is provided to the rear of the needle bar 6. A presser mechanism 90 (refer to FIG. 6) that is provided inside the head portion 14 is driven by a presser motor 99 (refer to FIG. 6), and the presser bar 17 is thus moved up and down. A presser holder 18 is attached to the lower end of the presser bar 17. A presser foot 19, which presses the work cloth, is detachably mounted on the presser holder 18.

As shown in FIG. 1, the embroidery frame movement mechanism 30 includes a main body case 21 that has a flat top surface and a movable case 48 that is disposed on the top side of the main body case 21. A slit 101 that extends in the left-right direction is provided in a central portion, in the front-rear direction, of the top surface of the main body case 21. A slit 102 that extends in the left-right direction is provided in the top portion of the front surface of the main body case 21.

The movable case 48 has a cuboid shape that is longer in the front-rear direction. The movable case 48 is provided internally with a frame holder (not shown in the drawings), a Y axis movement mechanism 93 (refer to FIG. 6) and a Y axis motor 83 (refer to FIG. 6). A part of the frame holder is exposed from the movable case 48 and an embroidery frame 9 can be detachably mounted on the frame holder. The embroidery frame 9 holds the work cloth. The work cloth held by the embroidery frame 9 is placed on the top of the bed portion 7 and below the needle bar 6 (refer to FIG. 3) and the presser foot 19 (refer to FIG. 2). The embroidery frame 9 will be explained in more detail later. The Y axis movement mechanism 93 is a mechanism that moves the frame holder in the front-rear direction (the Y direction). The embroidery frame 9 that holds the work cloth moves in the front-rear direction by the frame holder being moved in the front-rear direction. The Y axis motor 83 drives the Y axis movement mechanism 93.

Figure 6:
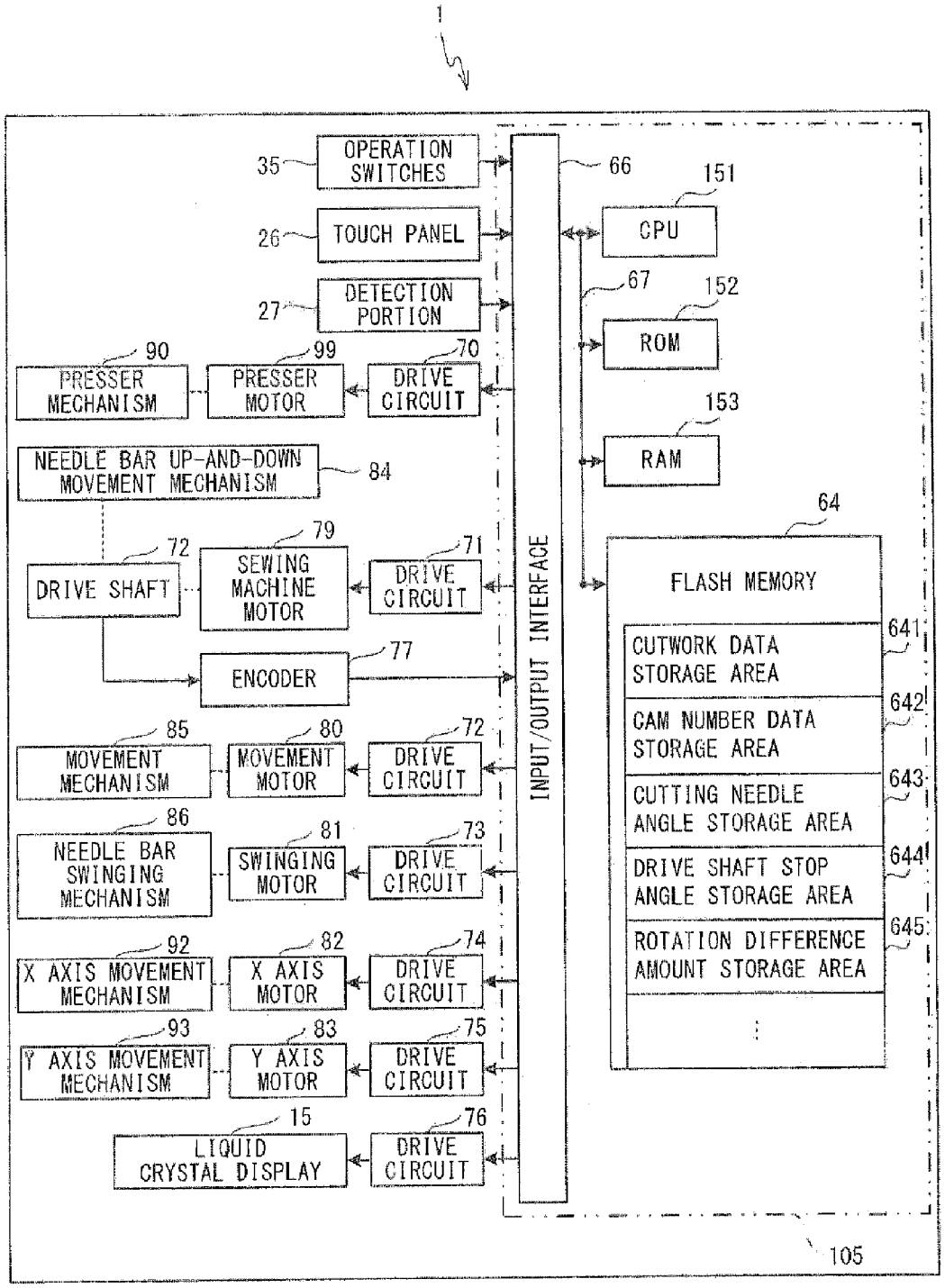
FIG. 6 is an example of a block diagram showing an electrical configuration of the sewing machine 1.

The main body case 21 is provided internally with an X axis movement mechanism 92 (refer to FIG. 6) and an X axis motor 82 (refer to FIG. 6). The X axis movement mechanism 92 moves the movable case 48 in the left-right direction (the X direction). A support portion (not shown in the drawings) that supports the movable case 48 passes through each of the slits 101 and 102 and is coupled to the X axis movement mechanism 92. The embroidery frame 9 that holds the work cloth moves in the left-right direction by the movable case 48 being moved in the left-right direction. The X axis motor 82 drives the X axis movement mechanism 92.

Figure 4:
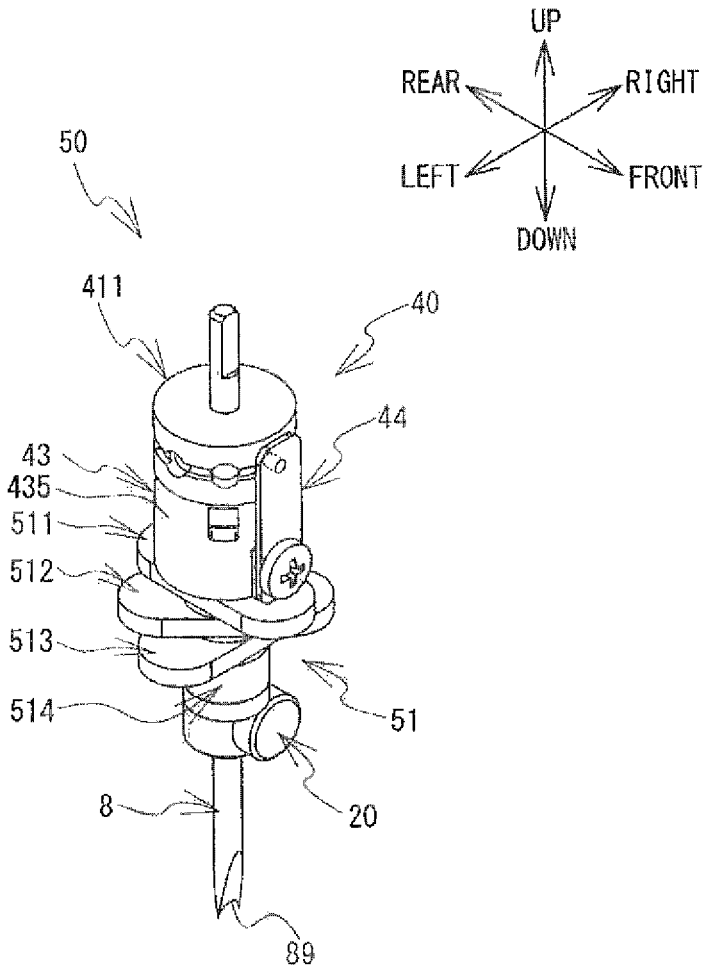
FIG. 4 is an example of a perspective view of the cutting needle rotation mechanism 50.

The structure of the cutting needle rotation mechanism 50 will be explained with reference to FIG. 4 and FIG. 5. As shown in FIG. 4, the cutting needle rotation mechanism 50 includes a support mechanism 40, a cam member 51 and the cutting needle 8. The support mechanism 40 is attached to the lower end of the needle bar 6 (refer to FIG. 3). The support mechanism 40 supports the cam member 51 such that the cam member 51 can rotate around the axial line of the needle bar 6. Further, the upper end of the cutting needle 8 is fixed to the lower end of the cam member 51. The axial line of the cutting needle 8 is aligned with the axial line of the needle bar 6 (refer to FIG. 3).

Figure 5:
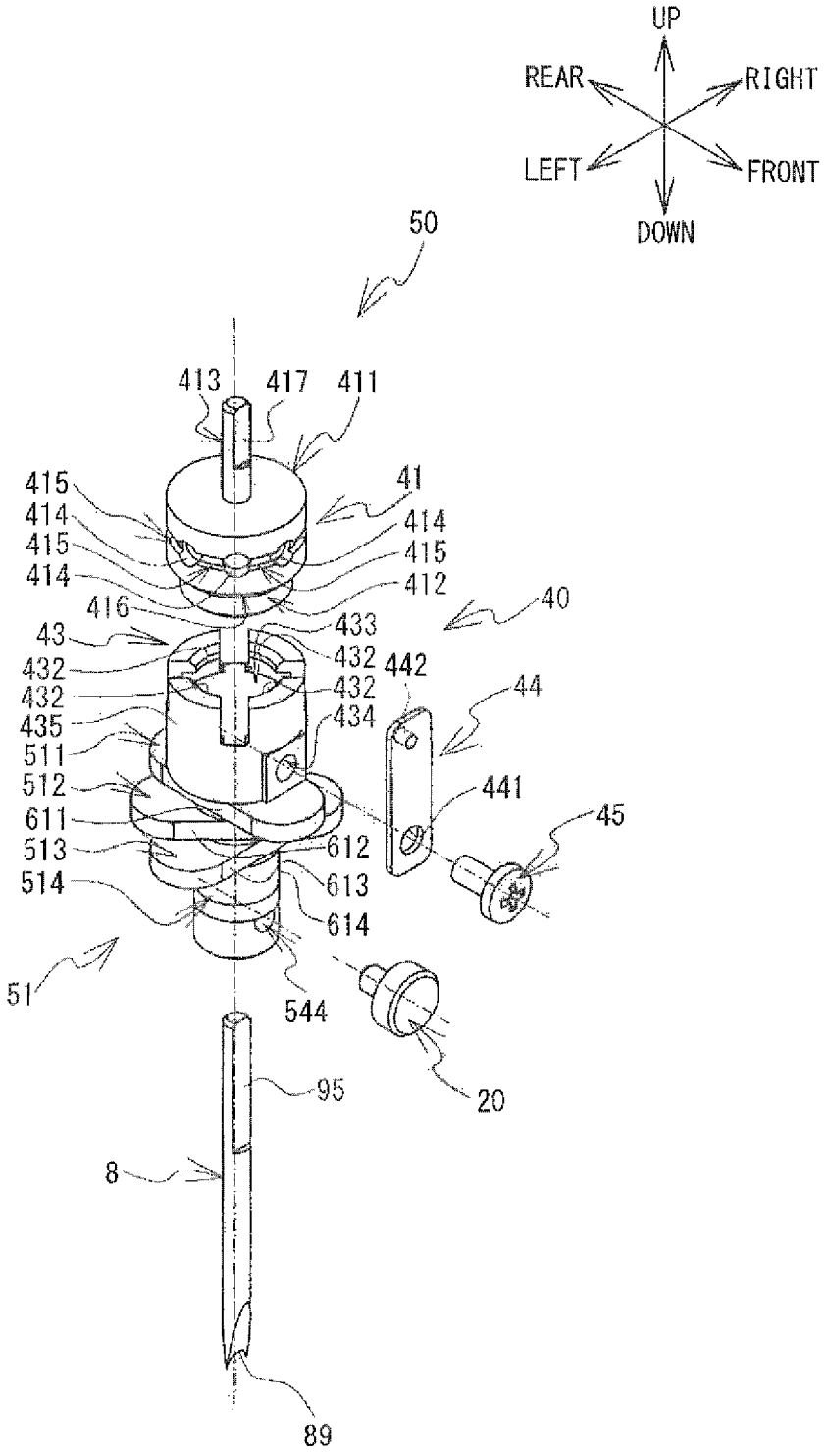
FIG. 5 is an example of an exploded perspective view of the cutting needle rotation mechanism 50.

As shown in FIG. 5, the support mechanism 40 includes a support member 41, a rotation member 43 and a plate spring 44. The support member 41 is formed of a synthetic resin material and is a substantially cylindrical shape that extends in the up-down direction. The axial line of the support member 41 is aligned with the axial line of the cutting needle 8. The support member 41 includes a first support portion 411 and a second support portion 412. The second support portion 412 extends downward from the lower end of the first support portion 411. The outer diameter of the second support portion 412 is smaller than the outer diameter of the first support portion 411. The first support portion 411 has a spindle 413, engagement receiving portions 414 and a groove portion 415. The spindle 413 is a shaft that extends upward from a central portion of the upper end surface of the first support portion 411. The spindle 413 is a metal shaft and is fixed to the first support portion 411 such that the spindle 413 cannot rotate. The axial line of the spindle 413 is aligned with the axial line of the support member 41. The upper end of the spindle 413 is attached to the needle bar 6 (refer to FIG. 3). A flat surface portion 417 is formed on the spindle 413 and the spindle 413 is attached to the needle bar 6 such that the flat surface portion 417 is parallel to a specific direction (the left-right direction in FIG. 5). With the above-described structure, the cutting needle rotation mechanism 50 is attached to the needle bar 6 with a specific orientation. The engagement receiving portions 414 are circular holes that are provided in an outer peripheral portion of the first support portion 411. The eight engagement receiving portions 414 are arranged every 45 degrees in a plan view, in the circumferential direction of the outer peripheral portion. The groove portion 415 is formed along the outer peripheral portion of the first support portion 411 and is a groove portion that joins the mutually adjacent engagement receiving portions 414. The second support portion 412 has a concave portion 416. The concave portion 416 is formed on the top end of the second support portion 412, in the circumferential direction of an outer peripheral portion.

The rotation member 43 is made of a synthetic resin and is a substantially cylindrical shape that extends in the up-down direction. The axial line of the rotation member 43 is aligned with the axial line of the support member 41. An insertion hole 433 is formed in the upper end of the rotation member 43. The insertion hole 433 is a hole that is substantially circular in a plan view and that extends downward from the top end surface of the rotation member 43. The inner diameter of the insertion hole 433 is slightly larger than the outer diameter of the second support portion 412. The second support portion 412 is inserted into the insertion hole 433. The insertion hole 433 is surrounded by an outer peripheral portion 435 of the rotation member 43. Four cut-out portions, which are cut out from the top toward the bottom, are arranged on the top end of the outer peripheral portion 435, each of the cut-out portions being arranged at equal intervals along the circumferential direction of the outer peripheral portion 435. The top end of the outer peripheral portion 435 is divided up by the four cut-out portions and each of the divided portions has a convex portion 432 that protrudes toward the inner side. The top end of the outer peripheral portion 435 can be elastically deformed in the radial direction. Each of the convex portions 432 fits with the concave portion 416. The inner dimension of each of the four convex portions 432 is slightly smaller than the outer diameter of the lower end of the second support portion 412, and slightly larger than the outer diameter of the outer peripheral portion of the portion of the second support portion 412 on which the concave portion 416 is formed. Here, when the rotation member 43 is assembled on the support member 41, the second support portion 412 is inserted into the insertion hole 433. At the time of insertion, the top end of the outer peripheral portion 435 deforms elastically and spreads to the outer side, and the convex portions 432 pass the lower portion of the second support portion 412. After that, when a position is reached in which each of the convex portions 432 fits with the concave portion 416, the divided portions of the top end of the outer peripheral portion 435 that were elastically deformed each return to their original shape. As described above, the movement of the rotation member 43 in the up-down direction is locked by the so-called snap fit of the convex portions 432 in the concave portion 416, and the rotation member 43 is then able to rotate around the axial line. With the above-described structure, the rotation member 43 is rotatably supported by the support member 41.

The plate spring 44 is a thin plate-shaped elastic member having a rectangular shape that is long in the up-down direction. A hole 441 is formed on the lower side (a base end side) of the plate spring 44. The hole 441 is aligned with the position of a screw hole 434 that is formed in the rotation member 43, and the plate spring 44 is fixed to the rotation member 43 by being fixed by a screw 45. An engagement portion 442 is formed on the upper side (a leading end side) of the plate spring 44. The engagement portion 442 is a convex portion that protrudes from the leading end of the plate spring 44 toward the axial line of the rotation member 43 (to the rear in FIG. 5). The engagement portion 442 engages with one of the eight engagement receiving portions 414.

The plate spring 44 imparts an urging force in a direction in which the engagement portion 442 engages with the engagement receiving portion 414 (a direction toward the axial line of the support member 41). As a result, the rotation of the rotation member 43 (to which the plate spring 44 is fixed) around its axial line is locked with respect to the support member 41.

The cam member 51 is a member that extends downward from a central portion of the lower end surface of the rotation member 43. The cam member 51 rotates integrally with the rotation member 43. The axial line of the cam member 51 is aligned with the axial line of the rotation member 43. The cam member 51 has cams 511 to 514 and a shaft hole (not shown in the drawings).

Each of the cams 511 to 514 is substantially elliptical in a plan view, each having a width in the up-down direction and each having mutually the same shape. The cams 511 to 514 are formed integrally such that they overlap with one another in the up-down direction. The centers of the cams 511 to 514 are all positioned on the axial line of the cam member 51.

In a rotation direction that is centered on the axial line of the cam member 51, the longitudinal direction of each of the cams 511 to 514 is displaced by 45 degrees, in a plan view, with respect to the mutually adjacent cam. When the left-right direction is taken as reference and the counter-clockwise direction is taken as a positive direction in the plan view, all the angles in the longitudinal direction of each of the cams 511 to 514 (hereinafter referred to as the "longitudinal direction angle") are different. In FIG. 4 and FIG. 5, the longitudinal direction angle of the cam 511 is 90 degrees, the longitudinal direction angle of the cam 512 is 135 degrees, the longitudinal direction angle of the cam 513 is zero degrees and the longitudinal direction angle of the cam 514 is 45 degrees. The cams 511 to 514 rotate integrally. In first cutting needle rotation processing that will be described later, the cams 511 to 514 rotate in the clockwise direction in the plan view and the longitudinal direction angle of each of the cams 511 to 514 thus changes every 45 degrees.

The cam 511 is provided with a contact receiving portion 611. Similarly, the cam 512 is provided with a contact receiving portion 612, the cam 513 is provided with a contact receiving portion 613 and the cam 514 is provided with a contact receiving portion 614. Each of the contact receiving portions 611 to 614 is formed of a pair of side wall portions that are symmetric with respect to the axial line of each of the cams 511 to 514. Each of the contact receiving portions 611 to 614 extends in the longitudinal direction of each of the cams 511 to 514. That is, the longitudinal direction of each of the contact receiving portions 611 to 614 is displaced by 45 degrees with respect to the adjacent one of the contact receiving portions 611 to 614, in the rotational direction around the axial line of the cam member 51. As will be described later, a contact portion 322 that is provided on the embroidery frame 9 comes into contact with one of the contact receiving portions 611 to 614.

The shaft hole (not shown in the drawings) is formed in a substantially D shape in a bottom view and extends upward from the bottom end surface of the cam member 51. As will be described later, the top end of the cutting needle 8 is inserted into the shaft hole. A screw hole 544 is provided in the lower end of the outer peripheral wall of the cam member 51 and communicates with the shaft hole.

The cutting needle 8 extends in the up-down direction and the lower end of the cutting needle 8 has the blade portion 89 that cuts out the work cloth. The blade portion 89 has a width in a direction that is orthogonal to the axial line of the cutting needle 8. The upper end of the cutting needle 8 has a substantially D shape in a plan view and is provided with a flat surface portion 95 that extends in parallel with the axial direction. The upper end of the cutting needle 8 is inserted into the shaft hole of the cam member 51 and is fixed to the cam member 51 in a state in which the flat surface portion 95 is pressed by the leading end of a screw 20 that is screwed into the screw hole 544. With the above-described structure, the cutting needle 8 rotates integrally with the cam member 51. The direction in which the blade portion 89 extends (hereinafter referred to as the width direction) is a specific direction (the left-right direction in FIG. 5).

Next, the embroidery frame 9 will be explained with reference to FIG. 1 and FIG. 2. The embroidery frame 9 has a known structure and is provided with an outer frame, an inner frame and an adjusting screw that is provided on the outer frame in order to adjust the size of the embroidery frame 9. However, for convenience of explanation in the present embodiment, the inner frame and the adjusting screw are not illustrated in the drawings and only the outer frame is illustrated. The embroidery frame 9 is formed as a ring that is substantially rectangular in a plan view. On the embroidery frame 9, a protruding portion 320 that protrudes upward is provided on a central portion, in the front-rear direction, of a right side portion of an outer frame 91. The protruding portion 320 includes a support portion 321 and a contact portion 322. The support portion 321 protrudes upward from the top surface of the central portion of the outer frame 91. The contact portion 322 is a substantially rectangular plate shape that is longer in the left-right direction in a plan view, and extends to the right from the top end of the support portion 321. The support portion 321 supports the contact portion 322. The width of the contact portion 322 in the up-down direction is substantially the same as the width of each of the cams 511 to 514 in the up-down direction.

When the first cutting needle rotation processing that will be described later is performed, a CPU 151 (refer to FIG. 6) moves the embroidery frame 9 such that the contact portion 322 of the embroidery frame 9 comes into contact with and presses the cam member 51. When the contact portion 322 comes into contact with and presses the cam member 51, the cam member 51 rotates by 45 degrees. As a result of the above-mentioned processing, the width direction of the blade portion 89 of the cutting needle 8 also extends in the direction in which the cam member 51 has rotated by 45 degrees. Further, before the cutwork operation is started, the embroidery frame 9 is in a position in which the contact portion 322 is separated to the left from the cam member 51. Hereinafter, this position is referred to as a withdrawn position.

An electrical configuration of the sewing machine 1 will be explained with reference to FIG. 6. A control portion 105 of the sewing machine 1 is provided with the CPU 151, a ROM 152, a RAM 153, a flash memory 64 and an input/output interface 66. The CPU 151, the ROM 152, the RAM 153, the flash memory 64 and the input/output interface 66 are electrically connected to each other via a bus 67. Various programs, including programs for the CPU 151 to execute cutwork execution processing and the first cutting needle rotation processing to be explained later, are stored in the ROM 152. Various information that is processed by the programs is temporarily stored in the RAM 153.

The flash memory 64 includes a cutwork data storage area 641, a cam number data storage area 642, a cutting needle angle storage area 643, a drive shaft stop angle storage area 644 and a rotation difference amount storage area 645 etc. Each of the storage areas will be explained in more detail later.

Cutting needle angles of the cutting needle 8 that are referred to in the cutwork execution processing (to be explained later) are stored in the cutting needle angle storage area 643. Here, the cutting needle angle is an angle formed in a plan view between the width direction of the blade portion 89 of the cutting needle 8 and a reference direction (the left-right direction). The cutting needle angle is zero degrees when the width direction of the blade portion 89 extends in the left-right direction (a state of the blade portion 89 shown in FIG. 2), and in a plan view in FIG. 2, the counterclockwise direction is the positive direction. The cutting needle angle of the cutting needle 8 that is initially attached to the needle bar 6 is zero degrees, and an initial value of the cutting needle angle stored in the cutting needle angle storage area 643 is also "0 degrees."

As shown in FIG. 6, the operation switches 35, the touch panel 26, a detection portion 27 and drive circuits 70 to 76 are electrically connected to the input/output interface 66. The detection portion 27 detects a type of the embroidery frame that is mounted on the frame holder (not shown in the drawings). Although not shown in the drawings, the sewing machine 1 is provided with a plurality of types of the embroidery frame. The detection portion 27 detects at least which of the embroidery frame 9 and an embroidery frame 10 that will be explained later is mounted on the frame holder, and transmits a detection result to the CPU 151 via the input/output interface 66. The drive circuits 70 to 76 drive the presser motor 99, the sewing machine motor 79, the movement motor 80, the swinging motor 81, the X axis motor 82, the Y axis motor 83 and the liquid crystal display 15, respectively.

An encoder 77 is a detector that detects a rotation angle of the drive shaft 72. The encoder 77 detects the rotation angle of the drive shaft 72 and transmits the detected rotation angle to the CPU 151 via the input/output interface 66.

Cutwork pattern data 100 will be explained with reference to FIG. 7. The cutwork pattern data 100 is stored in the cutwork data storage area 641 (refer to FIG. 6). The cutwork pattern data 100 is data that is referred to by the CPU 151 in the cutwork execution processing and the first cutting needle rotation processing that will be explained later. The blade portion 89 of the cutting needle 8 has the width that is orthogonal to the axial line of the cutting needle 8 (the left-right direction in FIG. 4). Thus, the direction of a cut formed in the work cloth (not shown in the drawings) by the cutting needle 8 is the same as the width direction. As a result, when the work cloth is cut using the cutting needle 8 along a contour of a specific pattern that is formed of a curved line, for example, along with moving the embroidery frame 9 in the X direction and the Y direction, it is necessary to rotate the cutting needle 8 and change the direction of the cuts formed in the work cloth. The cutwork pattern data 100 is data to generate a specific pattern etc. by cutting out the work cloth. The cutwork pattern data 100 is stored in the cutwork data storage area 641 for each cutwork pattern that is formed in the work cloth by the sewing machine 1.

The cutwork pattern data 100 includes a needle drop number N, X coordinate data, Y coordinate data and cutting needle angle data, and each of the data items are stored in association with each other. The needle drop number N is a variable that indicates an order in which the work cloth is cut. "CUT_END" that is noted in the lowest column of the needle drop number N is a final number of the needle drop number N and is a number such as 200 or 300 etc. In the following explanation, "CUT_END" is a maximum value of the needle drop number N of the cutwork pattern data 100. The X coordinate data and the Y coordinate data are data of coordinates of needle drop points (points at which a center portion of the blade portion 89 pierces the work cloth) in an embroidery coordinate system that is specific to the sewing machine 1 and that is set in advance. It should be noted that a position at which a center point of the embroidery frame 9 is aligned with a needle drop point is an origin point of the embroidery coordinate system. The cutting needle angle data is data indicating the cutting needle angle of the cutting needle 8.

The cam number data 210 will be explained with reference to FIG. 8. The cam number data 210 is stored in the cam number data storage area 642. The cam number data 210 is data that is referred to by the CPU 151 in the first cutting needle rotation processing that will be explained later. The cam number data 210 includes cutting needle angle difference data and data of a current cutting needle angle. Here, the cutting needle angle difference refers to a value that is obtained by subtracting the cutting needle angle of the cutting needle 8 at a present time (hereinafter referred to as a "current cutting needle angle") from a cutting needle angle of the cutting needle 8 that is desired to be set (hereinafter referred to as a "set cutting needle angle"). The data of the current cutting needle angle further includes a number of contacts P. As described above, in the cam number data 210, data of the contact cam number is stored in association with each item of the cutting needle angle difference data, the current cutting needle angle and the number of contacts P. The data of the contact cam number is "1" to "4" and corresponds to each of the cams 511 to 514. The cutting needle angle difference data is "45 degrees," "90 degrees" and "135 degrees." The current cutting needle angle data is "0 degrees," "45 degrees," "90 degrees" and "135 degrees." The cutting needle angle difference data only has three values because the cutting needle 8 only rotates by 45 degrees at a time and when the cutting needle angle is 180 degrees, that is the same as 0 degrees. The number of contacts P is divided into "P=1," "P=2" and "P=3" for each of the current cutting needle angle data. The number of contacts P is 1 to 3 because the cutting needle 8 only rotates by 45 degrees at a time and when the cutting needle 8 performs four rotations, the cutting needle angle becomes 180 degrees, which means that the cutting needle angle is essentially 0 degrees.

Drive shaft stop angle data 220 that is stored in the drive shaft stop angle storage area 644 (refer to FIG. 6) will be explained with reference to FIG. 9. The drive shaft stop angle data 220 is data that is referred to by the CPU 151 in the first cutting needle rotation processing that will be explained later. In the drive shaft stop angle data 220, a cam number M and drive shaft stop angle data are stored in association with each other. The cam numbers M 1 to 4 correspond to the cams 511 to 514, respectively. The drive shaft stop angle data 220 is data indicating a rotation angle at which the drive shaft 72 stops, and is data that is used to stop the needle bar 6 at a position at which the contact portion 322 is the same height as the contact receiving portion of the cam that corresponds to the cam number M.

Rotation difference amount data 230 that is stored in the rotation difference amount storage area 645 (refer to FIG. 6) will be explained with reference to FIG. 10. The rotation difference amount data 230 is data that is referred to by the CPU 151 in the first cutting needle rotation processing that will be explained later. As will be described later, when the CPU 151 causes the contact portion 322 to successively come into contact with the cams 511 to 514, the CPU 151 refers to the rotation difference amount data 230. Here, the rotation difference amount data 230 is data of a rotation amount of the drive shaft 72 that is used to move and stop the needle bar 6 such that, after the contact portion 322 has come into contact with one of the cams 511 to 514, the contact portion 322 is at a height at which it can come into contact with another of the cams 511 to 514. In the rotation difference amount data 230, data of the rotation difference amount is set and stored in association with each of the current cam number M and the cam number M with which contact will next be caused (hereinafter referred to as the next contact cam number M). The current cam number M is the number of the cam that was in contact with the contact portion 322 immediately before. The numbers 1 to 4 of the current cam numbers M correspond to the cams 511 to 514, respectively. When the contact portion 322 comes successively into contact with the cams 511 to 514, the next contact cam number M is the number of the cam that will next come into contact with the contact portion 322. The numbers 1 to 4 of the next contact cam numbers M correspond to the cams 511 to 514, respectively.

The cutwork execution processing that is performed by the CPU 151 will be explained with reference to FIG. 11. The cutwork execution processing is started when the power source of the sewing machine 1 is turned on and the user inputs a command using the operation switches 35 and the touch panel 26 etc. When the CPU 151 of the sewing machine 1 detects the input of the start command of the cutwork execution processing, the CPU 151 reads the program to perform the cutwork execution processing from the ROM 152 (refer to FIG. 6) into the RAM 153. Then, the CPU 151 performs each step of the processing as explained below, in accordance with instructions included in the program. The user uses the operation switches 35 and the touch panel 26 etc. to select the cutwork pattern to be made on the work cloth (not shown in the drawings), and commands the cutwork to be executed.

In the cutwork execution processing, first the CPU 151 acquires the cutwork pattern data 100 (step S11). The CPU 15 refers to the cutwork data storage area 641, and acquires the cutwork pattern data 100 associated with the cutwork pattern selected by the user. The CPU 151 sets the needle drop number N to "1" (step S13). The set needle drop number N is stored in the RAM 153. Next, the CPU 151 performs the first cutting needle rotation processing (step S15).

The first cutting needle rotation processing will be explained with reference to FIG. 12. The first cutting needle rotation processing is processing to match the angle indicated by the cutting needle angle data stored in association with the needle drop number N in the cutwork pattern data 100 (refer to FIG. 7) acquired at step S11 with the cutting needle angle of the cutting needle 8.

In the first cutting needle rotation processing, first the CPU 151 acquires the current cutting needle angle of the cutting needle 8 (step S30). The CPU 151 refers to the cutting needle angle storage area 643 (refer to FIG. 6) and acquires the cutting needle angle stored therein. The CPU 151 determines whether the current cutting needle angle is the same as the cutting needle angle associated with the needle drop number N in the cutwork pattern data 100 (step S31) The CPU 151 refers to the cutwork pattern data 100 stored in the cutwork data storage area 641 (refer to FIG. 6), acquires the cutting needle angle associated with the needle drop number N, and compares the acquired cutting needle angle with the current cutting needle angle acquired at step S30. When the current cutting needle angle and the cutting needle angle associated with the needle drop number N are the same (yes at step S31), the CPU 151 ends the first cutting needle rotation processing and returns the processing to the cutwork execution processing (refer to FIG. 11).

When the cutting needle angle data acquired from the cutting needle angle storage area 643 is "0 degrees," for example (step S30), and the needle drop number N is "1," the cutting needle angle data stored in the cutwork pattern data 100 is also "0 degrees" (yes at step S31). In this case, the first cutting needle rotation processing is ended.

Figure 11:
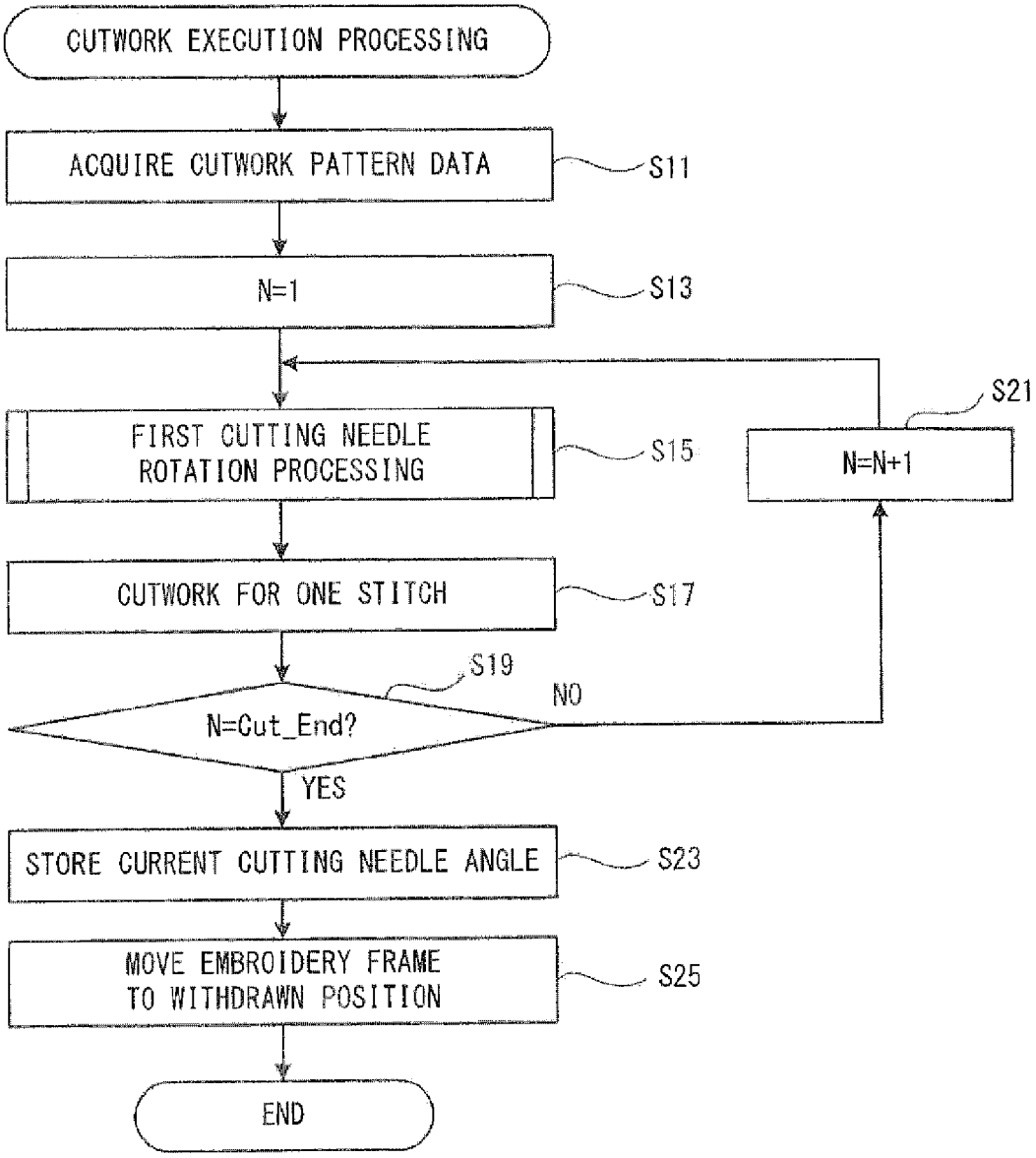
FIG. 11 is an example of a flowchart of cutwork execution processing.

As shown in FIG. 11, after the first cutting needle rotation processing is ended, the CPU 151 performs the cutwork of one stitch associated with the needle drop number N (step S17). After the cutwork is performed, the sewing machine motor 79 drives the needle bar up-and-down movement mechanism 84 (refer to FIG. 6) until the needle bar 6 (that is, the cutting needle 8) moves to the top needle position. For example, when the needle drop number N is "1," in the cutwork pattern data 100, the X coordinate data of the needle drop point is "x1" and the Y coordinate data is "y1" as shown in FIG. 7. The CPU 151 therefore controls the drive circuits 74 and 75, drives the X axis motor 82 and the Y axis motor 83, and moves the embroidery frame 9 such that the needle drop point is at the X coordinate "x1" and the Y coordinate "y1." Then the CPU 151 controls the drive circuit 71, drives the sewing machine motor 79, and lowers the needle bar 6. As a result of the above-described processing, the cutwork is performed in which the blade portion 89 of the cutting needle 8 cuts the work cloth. The CPU 151 controls the drive circuit 71 and drives the sewing machine motor 79, and thus drives the needle bar up-and-down movement mechanism 84 (refer to FIG. 6) until the cutting needle 8 moves to the top needle position.

Next, the CPU 151 determines whether the needle drop number N is "CUT_END" (step S19). The CPU 151 performs the determination by referring to the needle drop number N stored in the RAM 153, and then comparing this needle drop number N to the needle drop number N "CUT_END" of the cutwork pattern data 100 that is stored in the cutwork data storage area 641 (refer to FIG. 6).

When it is determined that the needle drop number N is not "CUT_END" (no at step S19), the CPU 151 increments the needle drop number N (step S21), and the incremented needle drop number N is stored in the RAM 153. After this, the CPU 151 returns the processing to step S15. For example, when the needle drop number N is "1" (no at step S19), the needle drop number N is incremented to "2" (step S21).

When the needle drop number N is "CUT_END" (yes at step S19), the CPU 151 overwrites and stores the current cutting needle angle in the cutting needle angle storage area 643 (step S23).

For example, when the needle drop number N is "CUT_END" (yes at step S19), the cutting needle angle data in the cutwork pattern data 100 is "0 degrees" (refer to FIG. 7) and the current cutting needle angle is 0 degrees. The CPU 151 sets the current cutting needle angle as "0 degrees," overwrites the cutting needle angle stored in the cutting needle angle storage area 643, and stores the current cutting needle angle (step S23).

Next, the CPU 151 controls the drive circuits 74 and 75, drives the X axis motor 82 and the Y axis motor 83, thus moving the embroidery frame 9 to the withdrawn position (step S25). After the embroidery frame 9 has been moved to the withdrawn position, the CPU 151 ends the cutwork execution processing. Note that, when the cutwork execution processing is ended, the cutting needle 8 is in the top needle position.

In the first cutting needle rotation processing shown in FIG. 12, in a case in which the current cutting needle angle is different to the cutting needle angle associated with the needle drop number N in the cutwork pattern data 100 (refer to FIG. 7), an explanation will be made when the needle drop number N is "2." When it is determined that the current cutting needle angle and the cutting needle angle associated with the needle drop number N are different (no at step S31), the CPU 151 acquires a cutting needle angle difference (step S32). The CPU 151 refers to the cutwork pattern data 100 stored in the cutwork data storage area 641 (refer to FIG. 6), and thus acquires the cutting needle angle associated with the needle drop number N. The CPU 151 subtracts the value of the current cutting needle angle acquired at step S30 from the acquired cutting needle angle associated with the needle drop number N, and thus acquires the cutting needle angle difference.

For example, when the needle drop number N is "2," at step S17 of the cutwork execution processing (refer to FIG. 11), the CPU 151 has completed the cutwork for one stitch when the needle drop number N is "1." As shown in FIG. 7, when the needle drop number N is "1," the corresponding cutting needle angle data is "0 degrees." Specifically, the current cutting needle angle of the cutting needle 8 is 0 degrees. When the needle drop number N is "2," the corresponding cutting needle angle data is "45 degrees," and is different to the current cutting needle angle (no at step S31). The set cutting needle angle is 45 degrees. Thus, the CPU 151 subtracts the current cutting needle angle (0 degrees) from the set cutting needle angle (45 degrees) and thereby acquires 45 degrees as the cutting needle angle difference (step S32).

Figure 12:
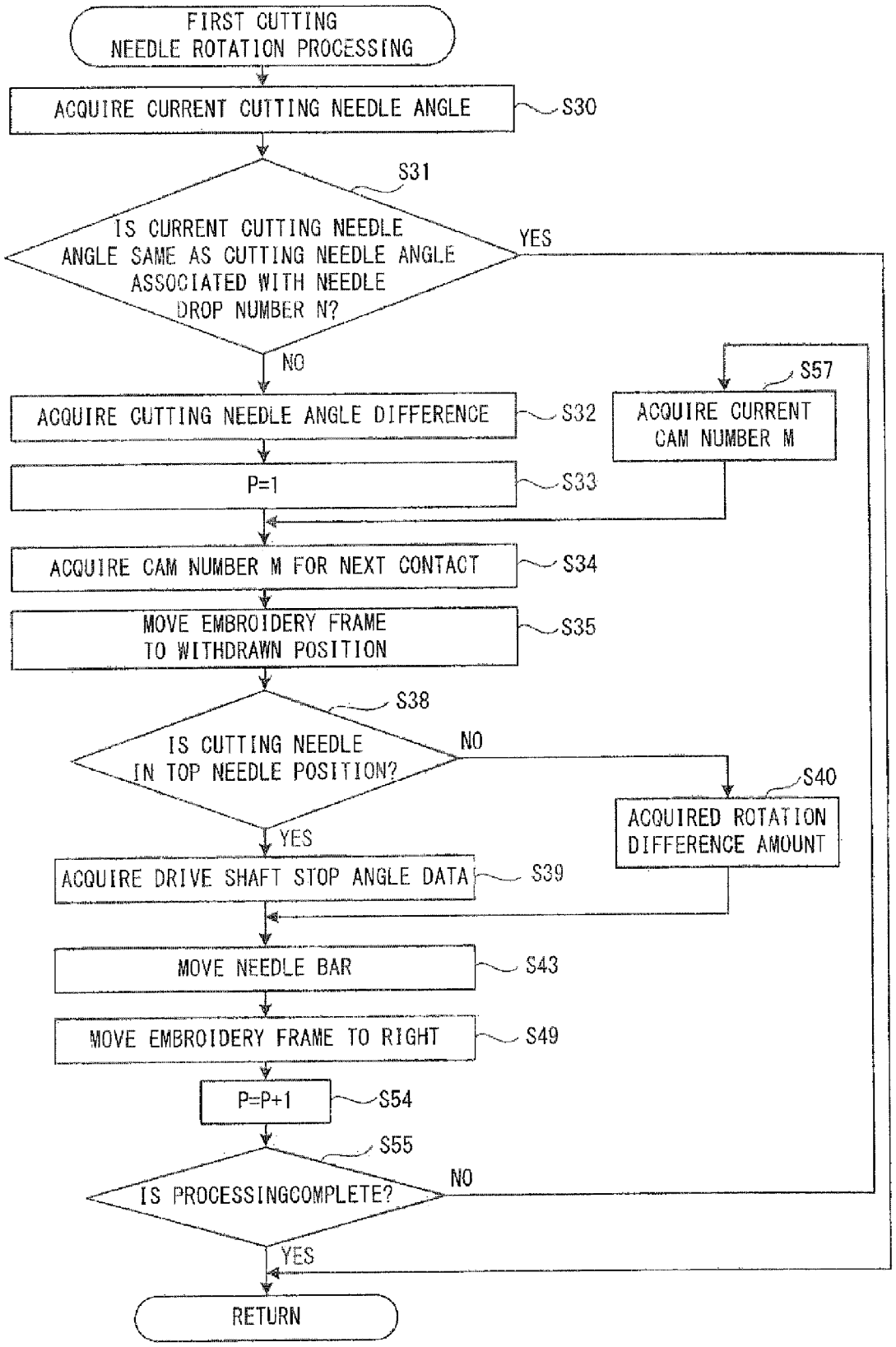
FIG. 12 is an example of a flowchart of first cutting needle rotation processing.

As shown in FIG. 12, the CPU 151 next sets "1" as the number of contacts P (step S33) and stores the set number of contacts P in the RAM 153. After that, the CPU 151 acquires the next contact cam number M (step S34). For example, when the needle drop number N is "2," as described above, the current cutting needle angle is "0 degrees" and the cutting needle angle difference acquired at step S32 is "45 degrees." Further, the number of contacts P is "1" (step S33). In this case, as shown in FIG. 8, in the cam number data 210, the cam number "2" is stored in association with the cutting needle angle difference "45 degrees," the current cutting needle angle "0 degrees" and the number of contacts P "1." Thus, the CPU 151 acquires "2" as the next contact cam number M (step S34).

Next, the CPU 151 controls the drive circuits 74 and 75, drives the X axis motor 82 and the Y axis motor 83, and lowers the embroidery frame 9 to the withdrawn position (step S35). For example, when the needle drop number N is "2," at step S17 of the cutwork execution processing (refer to FIG. 11), the CPU 151 has completed the cutwork for one stitch when the needle drop number N is "1." As shown in FIG. 7, when the needle drop number N is "1," the X coordinate data of the corresponding needle drop point is "x1," and the Y coordinate data is "y1." In other words, the embroidery frame 9 is not in the withdrawn position and therefore the CPU 151 controls the drive circuits 74 and 75 and moves the embroidery frame 9 to the withdrawn position (step S35).

Next, the CPU 151 determines whether the needle bar 6 (that is, the cutting needle 8) is in the top needle position (step S38). The CPU 151 determines whether the cutting needle 8 is in the top needle position, based on a signal output from the encoder 77 (refer to FIG. 6). When it is determined that the cutting needle 8 is in the top needle position (yes at step S38), the CPU 151 refers to the drive shaft stop angle data 220 that is stored in the drive shaft stop angle storage area 644 (refer to FIG. 6), and thus acquires the drive shaft stop angle data associated with the cam number M acquired at step S34 (step S39).

For example, when the needle drop number N is "2" and the number of contacts P is 1, by the processing by the CPU 151 at step S17 of the cutwork execution processing (refer to FIG. 11), the cutting needle 8 is in the top needle position (yes at step S38). As described above, when the needle drop number N is "2," the next contact cam number M acquired at step S34 is "2." In this case, as shown in FIG. 9, a drive shaft stop angle "A2" that is stored in the drive shaft stop angle data 220 is acquired (step S39). The contact receiving portion of the cam associated with the next contact cam number M "2" is the contact receiving portion 612 (refer to FIG. 5). Specifically, the drive shaft stop angle "A2" is set to move and stop the needle bar 6 such that the contact receiving portion 612 is at a height at which it can come into contact with the contact portion 322 (refer to FIG. 3).

Next, the CPU 151 controls the drive circuit 71, drives the sewing machine motor 79 such that the rotation angle of the drive shaft 72 is the drive shaft stop angle "A2" acquired at step S39, and moves the needle bar 6 (step S43).

Figure 13:
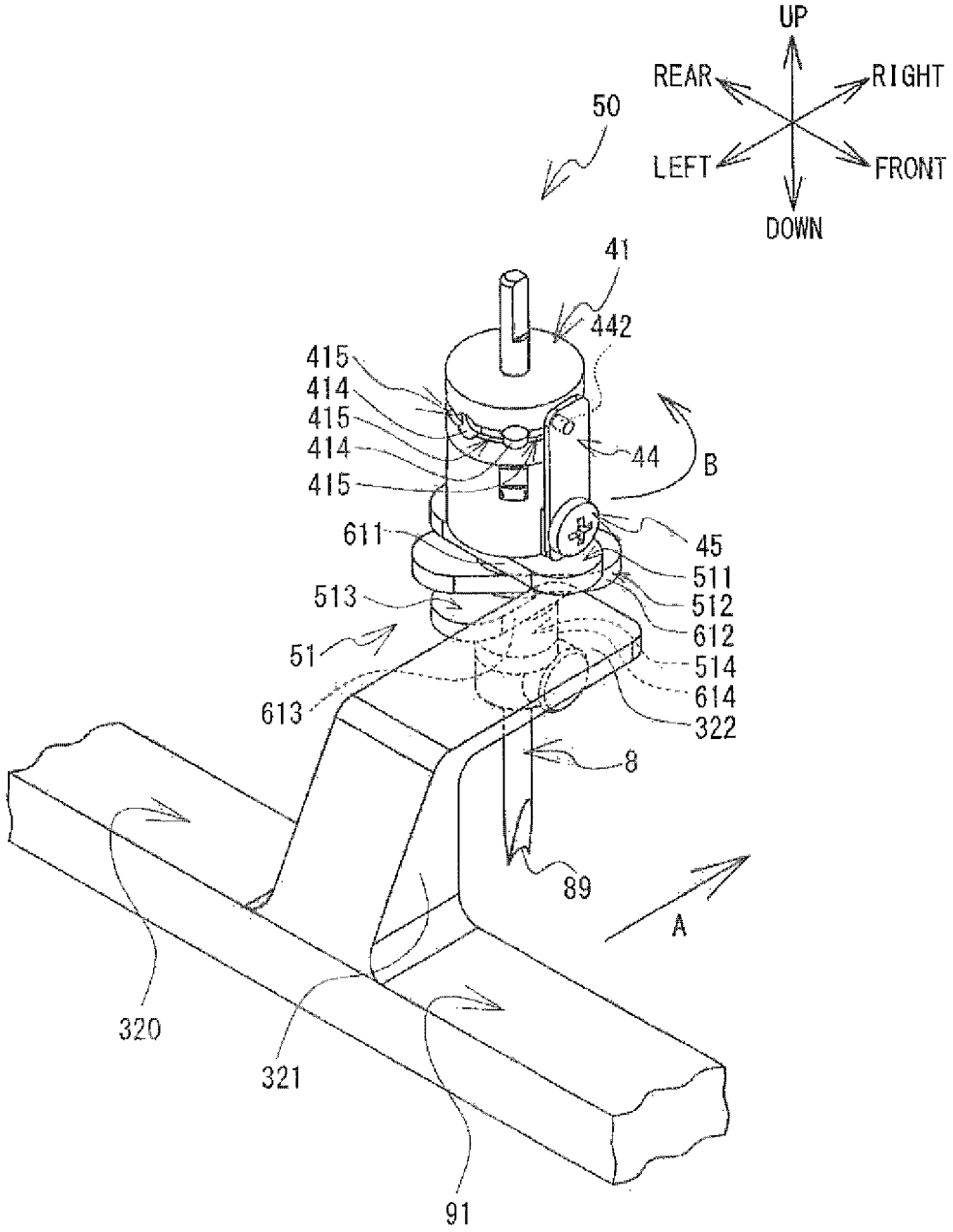
FIG. 13 is an example of a perspective view of a contact portion 322 causing a cam 512 to rotate.

Next, the CPU 151 controls the drive circuit 74, drives the X axis motor 82, and moves the embroidery frame 9 toward the right (the direction of an arrow A shown in FIG. 13) (step S49). By this movement, the contact portion 322 comes into contact with and presses the contact receiving portion 612 of the cam 512 that corresponds to the cam number M "2" acquired at step S34. More specifically, the contact portion 322 presses a portion of the contact receiving portion 612 that is to the front and the right of the cutting needle 8 to the right. By this pressing, the contact portion 322 causes the cam 512 to rotate in the counter-clockwise direction (the direction of an arrow B) in a plan view, around the axial line of the cam member 51. The cam member 51, the cutting needle 8, the rotation member 43 and the plate spring 44 also rotate integrally with the rotation of the cam 512. When the plate spring 44 rotates, the engagement portion 442 resists the urging force imparted by the plate spring 44, is displaced from the engagement receiving portion 414 with which it was engaged, and moves along the groove portion 415 while rotating in the counter-clockwise direction in a plan view (in the direction of the arrow B). The engagement portion 442 engages with the engagement receiving portion 414 that is adjacent to the engagement receiving portion 414 with which it was hitherto engaged (hereinafter referred to as the next engagement receiving portion 414). By the above-described processing, the plate spring 44 once more imparts an urging force in the direction in which the engagement portion 442 engages with the next engagement receiving portion 414 (in the direction toward the axial line of the support member 41). By this urging, the rotation of the cam member 51, the cutting needle 8 and the rotation member 43 is locked. After the rotation of the rotation member 43, the angles in the longitudinal direction of the cams 511 to 514 are 135 degrees, 0 degrees, 45 degrees and 90 degrees, respectively.

As shown in FIG. 12, the CPU 151 next increments the number of contacts P (step S54), and stores the incremented value P in the RAM 153. After that, the CPU 151 determines whether the processing is complete (step S55). The CPU 151 refers to the cam number data 210 (refer to FIG. 8) stored in the cam number data storage area 642 (refer to FIG. 6), and determines that the processing is complete when the cam number M associated with the current cutting needle angle acquired at step S30, the cutting needle angle difference acquired at step S32 and the number of contacts P incremented at step S54 is "_". The CPU 151 further determines that the processing is complete when the number of contacts P is "4." When it is determined that the processing is complete (yes at step S55), the CPU 151 ends the first cutting needle rotation processing and returns the processing to the cutwork execution processing (refer to FIG. 11).

When the needle drop number N is "2," for example, as described above, the current cutting needle angle acquired at step S30 is "0 degrees" and the cutting needle angle difference acquired at step S32 is "45 degrees." When the number of contacts P is incremented from "1" to "2" (step S54), in the cam number data 210, the cam number associated with the cutting needle angle difference "45 degrees," the current cutting needle angle "0 degrees" and the number of contacts P "2" is "-," as shown in FIG. 8. It is therefore determined that the processing is complete (yes at step S55) and the CPU 151 ends the first cutting needle rotation processing.

Next, a case will be explained in which the execution of the first cutting needle rotation processing is started and it is determined at step S55 that the processing is not complete. In the following explanation, it is assumed that the needle drop number N is "3." When the needle drop number N is "3," the outwork of one stitch has been performed when the needle drop number N is "2" at step S17 in the cutwork execution processing (refer to FIG. 11). In the cutwork pattern data 100 (refer to FIG. 7), when the needle drop number N is "2," the cutting needle angle data is "45 degrees," and when the needle drop number N is. "3," the cutting needle angle data is "135 degrees." Therefore, the current cutting needle angle acquired at step S30 is "45 degrees." Further, the cutting needle angle difference acquired at step S32 is "90 degrees," which is obtained by subtracting 45 degrees from 135 degrees. In addition, in the cam number data 210 shown in FIG. 8, the cam number data associated with the current cutting needle angle "45 degrees," the cutting needle angle difference "90 degrees" and the number of contacts P "1" is "1." As a result, the contact cam number M acquired at step S34 is "1."

When the needle drop number N is "3," at step S17 of the cutwork execution processing (refer to FIG. 11), the cutwork of the one stitch associated with the needle drop number N of "2" has already been performed, and the needle drop number N is incremented at step S21. After that, the execution of the first cutting needle rotation processing is started once more. In this case, the processing from step S30 to step S54 is the same as in the above explanation.

As shown in FIG. 12, the CPU 151 determines whether the processing is complete (step S55). When the needle drop number N is "3," for example, as described above, the current cutting needle angle acquired at step S30 is "45 degrees," and the cutting needle angle difference acquired at step S32 is "90 degrees." As shown in FIG. 8, in the cam number data 210, the cam number associated with the current cutting needle angle "45 degrees," the cutting needle angle difference "90 degrees" and the number of contacts P "2" that is incremented at step S54 is "4" and is not "-." Further, the incremented number of contacts P is "2" and is not "4." As a result, it is determined that the processing is not complete (no at step S55).

Next, the CPU 151 acquires the current cam number M (step S57). The CPU 151 acquires the next contact cam number M (acquired at step S34) as the current cam number. As described above, the cam number already acquired at step S34 is "1," for example. Therefore, the current cam number M is acquired as "1."

The CPU 151 acquires the next contact cam number of the current cam number (step S34). For example, in the cam number data 210 shown in FIG. 8, the cam number associated with the current cutting needle angle "45 degrees," the cutting needle angle difference "90 degrees" and the number of contacts P "2" is "4." Thus, "4" is acquired as the next contact cam number M (step S34).

Next, the CPU 151 performs step S35. This processing is the same as in the explanation above and an explanation is therefore omitted here.

Next, the CPU 151 determines whether the cutting needle 8 is in the top needle position (step S38). When it is determined that the cutting needle 8 is not in the top needle position (no at step S38), the CPU 151 advances the processing to step S40. For example, when the needle drop number N is "3" and the number of contacts P is "2," the CPU 151 has already performed the processing associated with the number of contacts P "1." In other words, the contact portion 322 is positioned at the height in which it can come into contact with the contact receiving portion 611, and the cutting needle 8 is not in the top needle position (no at step S38).

Next, the CPU 151 acquires the rotation difference amount (step S40). The CPU 151 refers to the current cam number M acquired at step S57, the next contact cam number M acquired at step S34 and the rotation difference amount data 230 stored in the rotation difference amount storage area 645 (refer to FIG. 6), and acquires the rotation difference amount.

When the needle drop number N is "3," and the number of contacts P is "2," for example, as described above, the current cam number M acquired at step S57 is "1" and the next contact cam number M acquired at step S34 is "4." As shown in FIG. 10, in the rotation difference amount data 230, the rotation difference amount associated with the current cam number M "1" and the next contact cam number M "4" is "A14." Therefore, the rotation difference amount "A14" is acquired (step S40). The contact receiving portion of the cam that corresponds to the next contact cam number M "4" is the contact receiving portion 614 (refer to FIG. 5). In other words, the rotation difference amount "A14" is set that moves and stops the needle bar 6 such that the contact receiving portion 614 is at a height at which it can come into contact with the contact portion 322 (refer to FIG. 3).

Next, the CPU 151 controls the drive circuit 71, drives the sewing machine motor 79 such that the drive shaft 72 is rotated by the rotation difference amount "A14" acquired at step S40, and moves the needle bar 6 (step S43).

Next, the CPU 151 performs the processing at step S49. This processing is the same as that in the above explanation.

After incrementing the number of contacts P (step S54), the CPU 151 determines whether the processing is complete (step S55). For example, when the needle drop number N is "3" and the number of contacts P is "2," the number of contacts P is incremented to "3" (step S54). As described above, the current cutting needle angle acquired at step S30 is "45 degrees" and the cutting needle angle difference acquired at step S32 is "90 degrees." As shown in FIG. 8, in the cam number data 210, the cam number associated with the current cutting needle angle "45 degrees," the cutting needle angle difference "90 degrees" and the number of contacts P "3" is "-" It is therefore determined that the processing is complete (yes at step S55) and the first cutting needle rotation processing is ended.

As explained above, the CPU 151 of the sewing machine 1 drives the sewing machine motor 79 and moves the cutting needle 8 to a position at which the contact portion 322 is the same height as one of the contact receiving portions 611 to 614 (step S43). Then, the CPU 151 drives the X axis motor 82, moves the embroidery frame 9 that is in the withdrawn position to the right, causes the contact portion 322 to come into contact with and rotate one of the contact receiving portions 611 to 614 (step S49). By this rotation, the CPU 151 rotates the cutting needle 8 by 45 degrees in the counter-clockwise direction. Thus, the sewing machine 1 can automatically cause the cutting needle 8 to rotate. Further, as the contact receiving portions 611 to 614 have the width in the up-down direction, when the embroidery frame 9 moves to the right, the contact portion 322 reliably comes into contact with the contact receiving portion of the cam associated with the next contact cam number M acquired at step S34. As a result, the sewing machine 1 can cause the cutting needle 8 to rotate in a stable manner.

In the rotation direction centered on the axial line of the cam member 51, the longitudinal direction of each of the contact receiving portions 611 to 614 is displaced by 45 degrees, in a plan view, with respect to the mutually adjacent contact receiving portion. With the above-described structure, among the contact receiving portions 611 to 614, the contact portion 322 comes into contact with the contact receiving portion of the cam whose longitudinal direction angle is 135 degrees and the cutting needle 8 is rotated by 45 degrees. After that, the longitudinal direction angle of one of the cams with which contact was not made becomes 135 degrees. In other words, when the cutting needle 8 rotates by 45 degrees at a time, the longitudinal direction angle of one of the cams 511 to 514 becomes 135 degrees. When causing the contact portion 322 to come into contact with one of the cams 511 to 514, the sewing machine 1 can always position the embroidery frame 9 at the same coordinate position. Namely, the sewing machine 1 can simplify the movement control of the embroidery frame 9. As a result, the sewing machine 1 can cause the cutting needle 8 to rotate in a more stable manner.

In addition, the engagement portion 442 of the plate spring 44 engages with one of the plurality of engagement receiving portions 414. As a result, the plate spring 44 urges the support member 41 in the direction in which the engagement portion 442 engages with the engagement receiving portion 414. By this urging, the rotation of the rotation member 43 is locked and the rotation of the cutting needle 8 is also locked. The sewing machine 1 can suppress unnecessary rotation of the cutting needle 8 when performing the outwork on the work cloth. The sewing machine 1 can therefore perform the cutwork on the work cloth in a stable manner. Furthermore, the cutting needle angle of the cutting needle 8 is determined by the position at which the engagement portion 442 engages with the next engagement receiving portion 414. As a result, the sewing machine 1 can accurately control the cutting needle angle of the cutting needle 8.

Note that the present disclosure is not limited to the above-described embodiment, and various modifications are possible. For example, in the above-described embodiment, the four cams 511 to 514 of the cam member 51 are arranged such that their respective angles in the longitudinal direction are mutually displaced by 45 degrees in a plan view. In place of the above-described arrangement, six cams may be provided, and their respective angles in the longitudinal direction may be mutually displaced by 30 degrees. Further, each of the shape, the size, the number and the angle in the longitudinal direction of the cam may be changed as appropriate.

Further, in the above-described embodiment, the contact portion 322 is provided such that it extends to the right from the support portion 321. However, the shape, size and installation position of the contact portion may be changed as appropriate. For example, the contact portion 322 may extend to the front or to the rear, and the embroidery frame 9 may be moved to the front or to the rear and caused to come into contact with the cam member 51. Further, the contact portion 322 is provided on the outer frame 91, but it may be provided on the inner frame.

Figure 14:
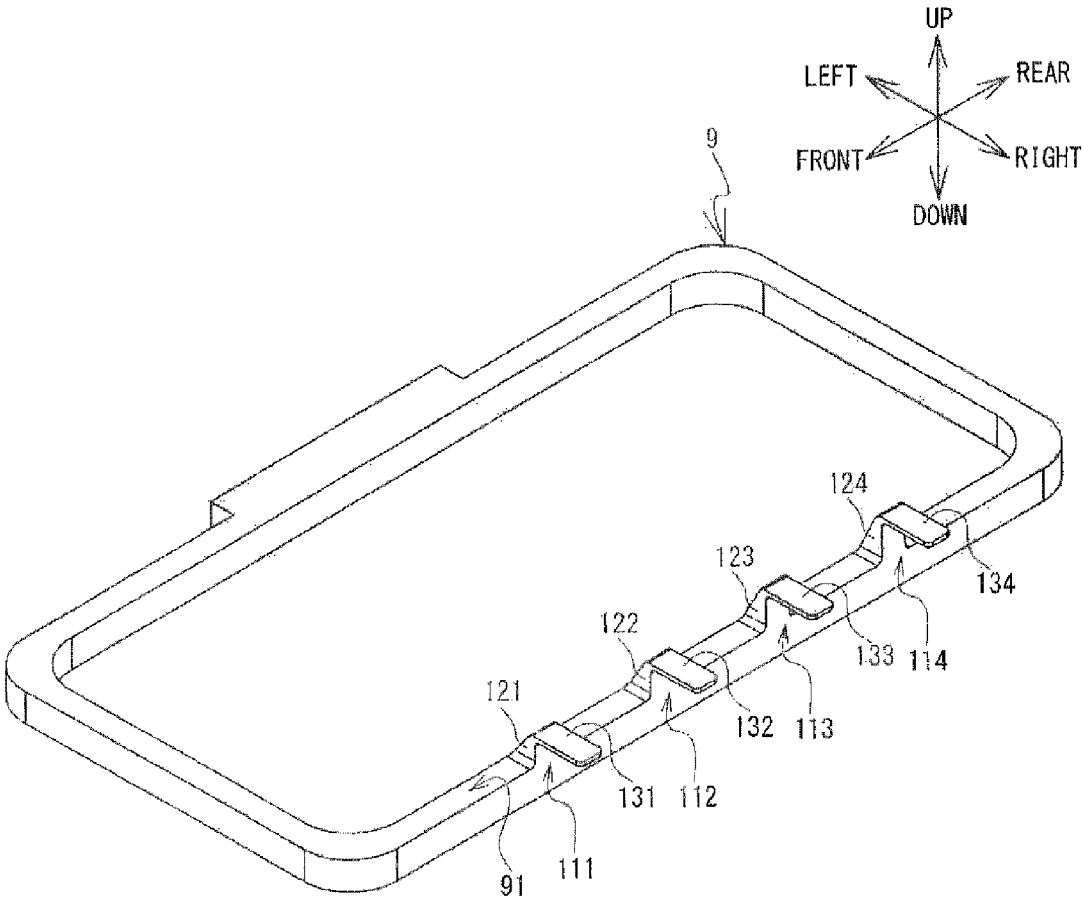
FIG. 14 is an example of a perspective view showing a modified example of an embroidery frame 9.

Further, in the above-described embodiment, only the one protruding portion 320 is provided on the outer frame 91 of the embroidery frame 9. Instead of the above-described structure, four protruding portions that correspond to each of the cams 511 to 514 may be provided. For example, as shown in FIG. 14, four protruding portions 111 to 114 are provided, from the front to the rear of the outer frame 91.

The protruding portion 111 is provided with a support portion 121 and a contact portion 131, the protruding portion 112 is provided with a support portion 122 and a contact portion 132, the protruding portion 113 is provided with a support portion 123 and a contact portion 133, and the protruding portion 114 is provided with a support portion 124 and a contact portion 134. The support portions 121 to 124 each protrude upward from the outer frame 91. The height of each of the support portions 121 to 124 becomes increasingly higher in order, from the support portion 121 to the support portion 124. Each of the contact portions 131 to 134 is a plate that extends to the right from the top end of each of the support portions 121 to 124. The contact portions 131 to 134 all have the same shape and their width in the up-down direction is the same as the width of the cams 511 to 514 in the up-down direction. In a state in which the needle bar 6 is stopped such that the top surface of the cam 511 is at a same position as the top surface of the contact portion 134, the top surfaces of the cams 512 to 514 are at the same heights as the contact portions 132 to 134, respectively.

Specifically, when the cutting needle 8 is lowered by a predetermined amount from the top needle position, the contact portion 131 is at a height at which it can come into contact with the contact receiving portion 614, the contact portion 132 is at a height at which it can come into contact with the contact receiving portion 613, the contact portion 133 is at a height at which it can come into contact with the contact receiving portion 612, and the contact portion 134 is at a height at which it can come into contact with the contact receiving portion 611. In addition, a coordinate position of the embroidery frame 9 at which each of the contact portions 131 to 134 can press the contact receiving portions 611 to 614 may be stored in a specific storage area of the flash memory 64. In this case, when the CPU 151 rotates the cutting needle 8 a plurality of times, such as when the CPU 151 rotates the cutting needle 8 by 45 degrees three times, for example, it is not necessary to re-set the height of the needle bar 6 after the first rotation has ended. In other words, after the first contact has ended at step S49 in the first cutting needle rotation processing, at step S35, the CPU 151 moves the embroidery frame 9 while referring to the specific storage area in the flash memory 64 in order to selectively cause one of the contact portions 131 to 134 to come into contact with the cam member 51. With the above-described structure, from the second contact onward, it is possible to render the processing at step S40 and step S43 unnecessary in the first cutting needle rotation processing.

Figure 15:
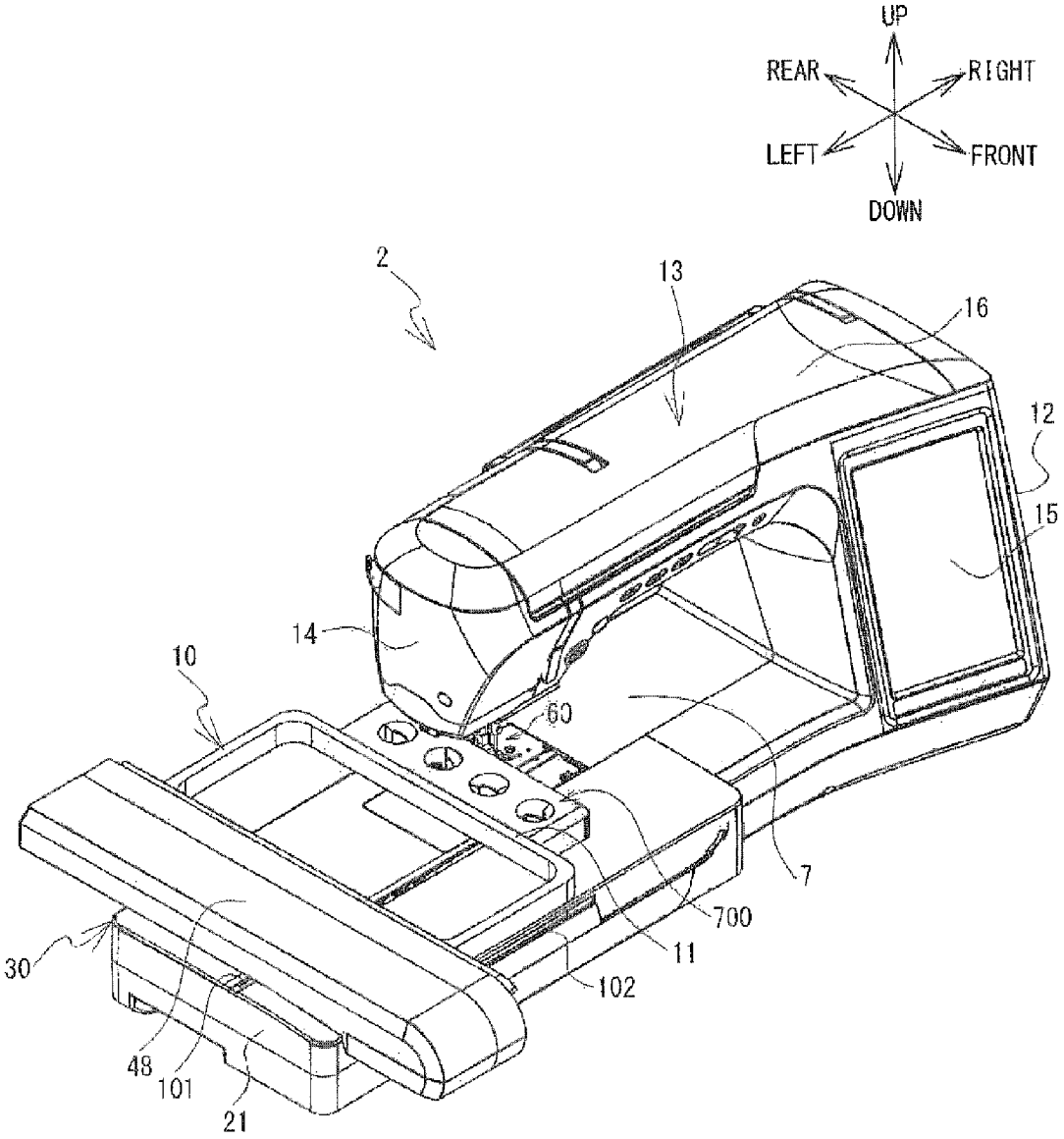
FIG. 15 is an example of a perspective view of a sewing machine 2.

Next, a sewing machine 2 according to a second embodiment of the present disclosure will be explained with reference to FIG. 15 to FIG. 21. In FIG. 15, members that are the same as those of the sewing machine 1 are assigned the same reference numerals. In the following explanation, an explanation will be omitted of configurations and operations that are the same as those of the sewing machine 1 according to the first embodiment. Note that, in the present embodiment, the cutting needle angle is 0 degrees in a state in which the blade portion 89 extends in the left-right direction (a state of the blade portion 89 shown in FIG. 16), and, in contrast to the first embodiment, the counter-clockwise direction in a plan view in FIG. 15 is the positive direction.

Figure 16:
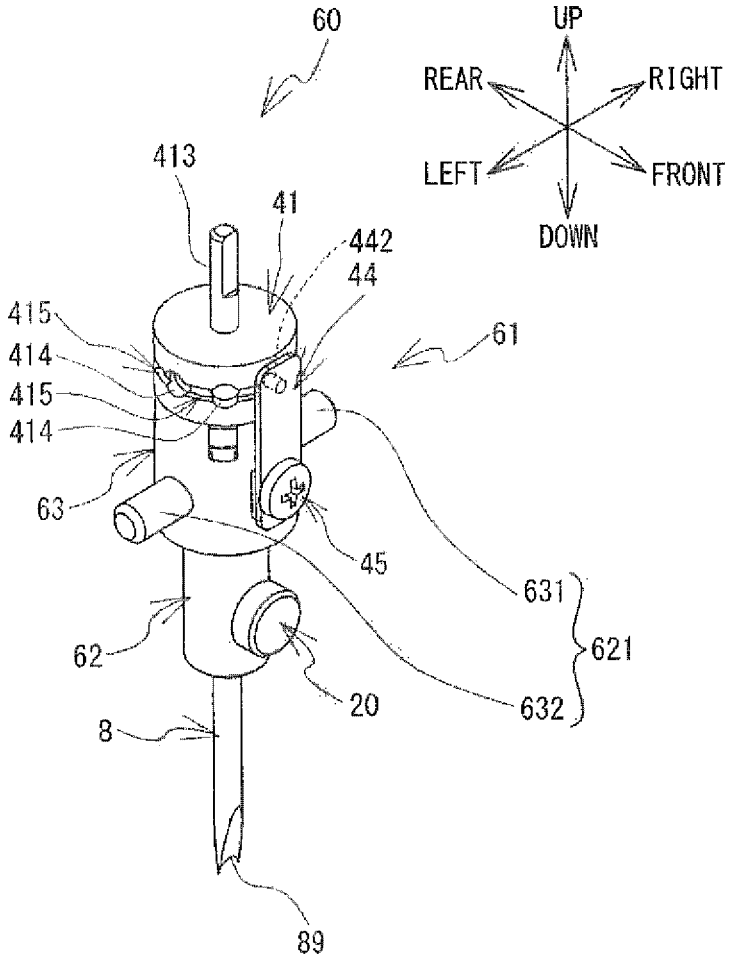
FIG. 16 is an example of a perspective view of a cutting needle rotation mechanism 60.

As shown in FIG. 15 and FIG. 16, the sewing machine 2 is different to the sewing machine 1 in that the sewing machine 2 is provided with a cutting needle rotation mechanism 60 instead of the cutting needle rotation mechanism 50 (refer to FIG. 4) that is provided on the sewing machine 1. The other physical structure and the electrical configuration of the sewing machine 2 are basically the same as those of the sewing machine 1. The cutting needle rotation mechanism 60 is provided with a support mechanism 61, a holding member 62 and the cutting needle 8. The shape of the cutting needle 8 of the cutting needle rotation mechanism 60 is the same as the shape of the cutting needle 8 of the cutting needle rotation mechanism 50.

The support mechanism 61 is provided with the support member 41, a rotation member 63 and the plate spring 44. The shape of the support member 41 and the plate spring 44 of the support mechanism 61 is the same as the shape of the support member 41 and the plate spring 44 of the support mechanism 40 and an explanation thereof is therefore omitted here.

The rotation member 63 is substantially cylindrical and is rotatably supported by the lower end of the support member 41. The axial line of the rotation member 63 is aligned with the axial line of the needle bar 6 (refer to FIG. 3). The rotation member 63 is provided with a protruding portion 621 that extends in a direction orthogonal to the axial line of the rotation member 63 (in the left-right direction in FIG. 16). The protruding portion 621 is a shaft member that is pressed into a through hole (not shown in the drawings) provided in the rotation member 63. The direction in which the protruding portion 621 extends is the same as the width direction of the blade portion 89 of the cutting needle 8. The protruding portion 621 is provided with a first protruding portion 631 and a second protruding portion 632. The first protruding portion 631 and the second protruding portion 632 protrude toward a direction that moves away from the axial line of the rotation member 63. The first protruding portion 631 and the second protruding portion 632 are provided such that they are symmetrical, centering on the axial line of the rotation member 63. Apart from the provision of the protruding portion 621, the rotation member 63 of the support mechanism 61 is the same as the rotation member 43 of the support mechanism 40.

The holding member 62 is a substantially cylindrical member that extends downward from a central portion of the lower end surface of the rotation member 63. The holding member 62 is integrally formed with the rotation member 63. The axial line of the holding member 62 is aligned with the rotation member 63. In a similar manner to the can member 51 of the cutting needle rotation mechanism 50, a shaft hole (not shown in the drawings) is provided in the lower end of the holding member 62. The upper end of the cutting needle 8 is inserted into the shaft hole and is fixed by the screw 20.

An embroidery frame 10 will be explained with reference to FIG. 15, FIG. 17 and FIG. 18. The sewing machine 2 is provided with the embroidery frame 10 in place of the embroidery frame 9 (refer to FIG. 1) with which the sewing machine 1 is provided. The embroidery frame 10 is the same as the embroidery frame 9, apart from a support member 700 that is provided on the embroidery frame 10 in place of the protruding portion 320 provided on the embroidery frame 9.

The support member 700 is a substantially rectangular shape that is longer in the front-rear direction in a plan view. The support member 700 is provided on a right side portion of an outer frame 11 of the embroidery frame 10. The support portion 700 is formed integrally with the outer frame 11. Four guide portions 711 to 714 are provided in a row on the support portion 700, from the front to the rear. As will be described below, each of the guide portions 711 to 714 guides the protruding portion 621 of the cutting needle rotation mechanism 60, and the cutting needle 8 can thus be rotated and the cutting needle angle can be changed.

The angle (the orientation) in a plan view of each of the four guide portions 711 to 714 is different, but apart from the angle, each of the guide portions 711 to 714 has the same shape. Thus, for ease of explanation, the structure of the guide portion 712 will be explained. Points of difference between the four guide portions 711 to 714 will be explained later. As shown in FIG. 17 and FIG. 18, the guide portion 712 includes a first insertion hole 802, a first inclined portion 812, a second inclined portion 822, a second insertion hole 872 and groove portions 832. The first insertion hole 802 is a circular hole, in a plan view, that penetrates through the support portion 700 in the up-down direction. The inner diameter of the first insertion hole 802 is larger than the length between both ends of the protruding portion 621.

The first inclined portion 812 and the second inclined portion 822 are provided along the inner peripheral surface of the first insertion hole 802. The first inclined portion 812 and the second inclined portion 822 form a shape that has point symmetry with respect to the axial line of the first insertion hole 802. A first guide surface 852 that is the top surface of the first inclined portion 812, and a second guide surface 862 that is the top surface of the second inclined portion 822 are inclined downward along the inner peripheral surface of the first insertion hole 802, in the clockwise direction in a plan view.

The second insertion hole 872 is formed on the inside of the first inclined portion 812 and the second inclined portion 822. The second insertion hole 872 is a circular hole in a plan view that penetrates through the support portion 700 in the up-down direction. The axial line of the second insertion hole 872 is aligned with an axial line of the first insertion hole 802.

The groove portions 832 are portions at which one end of the first inclined portion 812 (the end in the counter-clockwise direction in a plan view) and one end of the second inclined portion 822 (the end in the clockwise direction in a plan view) face each other and at which the other end of the first inclined portion 812 and the other end of the second inclined portion 822 face each other. The two groove portions 832 are provided on either side of the axial line of the first insertion hole 802. The groove portions 832 are connected to the lower end of the first guide surface 852 and the lower end of the second guide surface 862, respectively. The width of each of the groove portions 832 is slightly larger than the outer diameter of the protruding portion 621.

The groove portions 832 extend toward the front right side from the rear left side in a plan view. Taking the left-right direction as a reference, when the counter-clockwise direction is taken as the positive direction in a plan view, the angle of the direction in which the groove portions 832 extend in a plan view (hereinafter referred to as an "extending direction angle") is 45 degrees. As will be explained later, the protruding portion 621 that moves while being guided by the first guide surface 852 and the second guide surface 862 fits into the groove portions 832. Specifically, the protruding portion 621 is guided by the first guide surface 852 and the second guide surface 862 and rotates around the axial line of the second insertion hole 872, and the cutting needle angle becomes the same as the extending direction angle of the groove portions 832. At that time, the head portion of the screw 20 that is screwed into the holding member 62 also rotates, but the size of the second insertion hole 872 is set such that interference with the head portion of the screw 20 does not occur.

Figure 17:
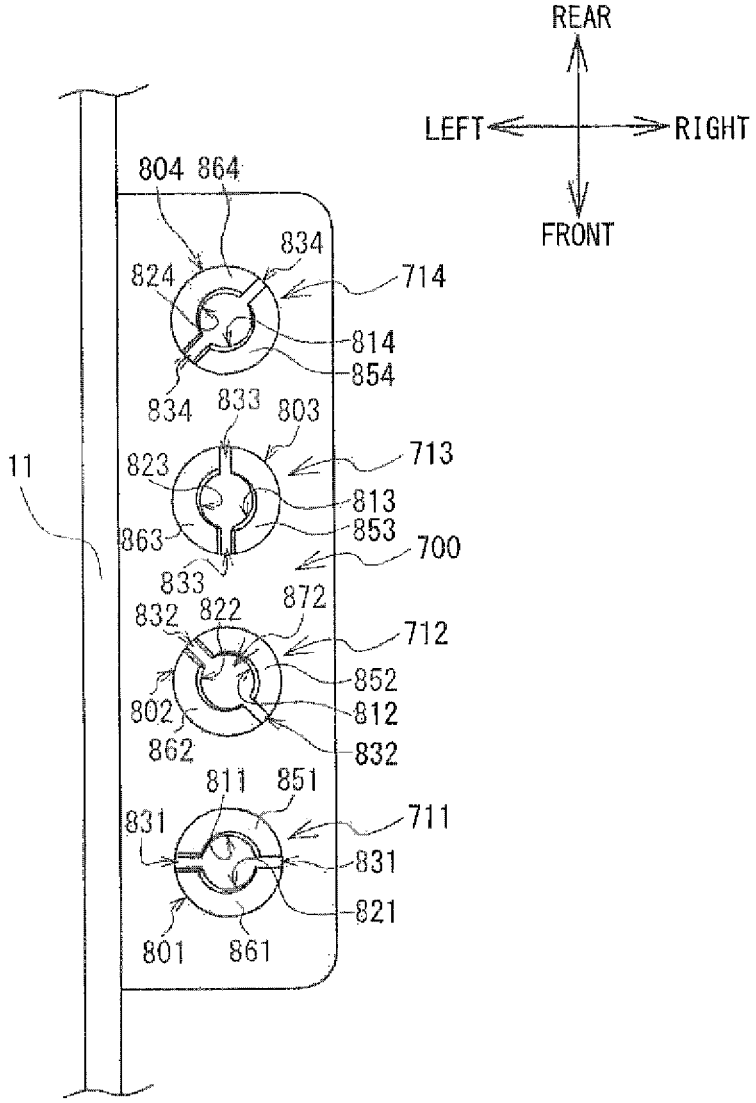
FIG. 17 is an example of a plan view of a support portion 700.
Figure 18:
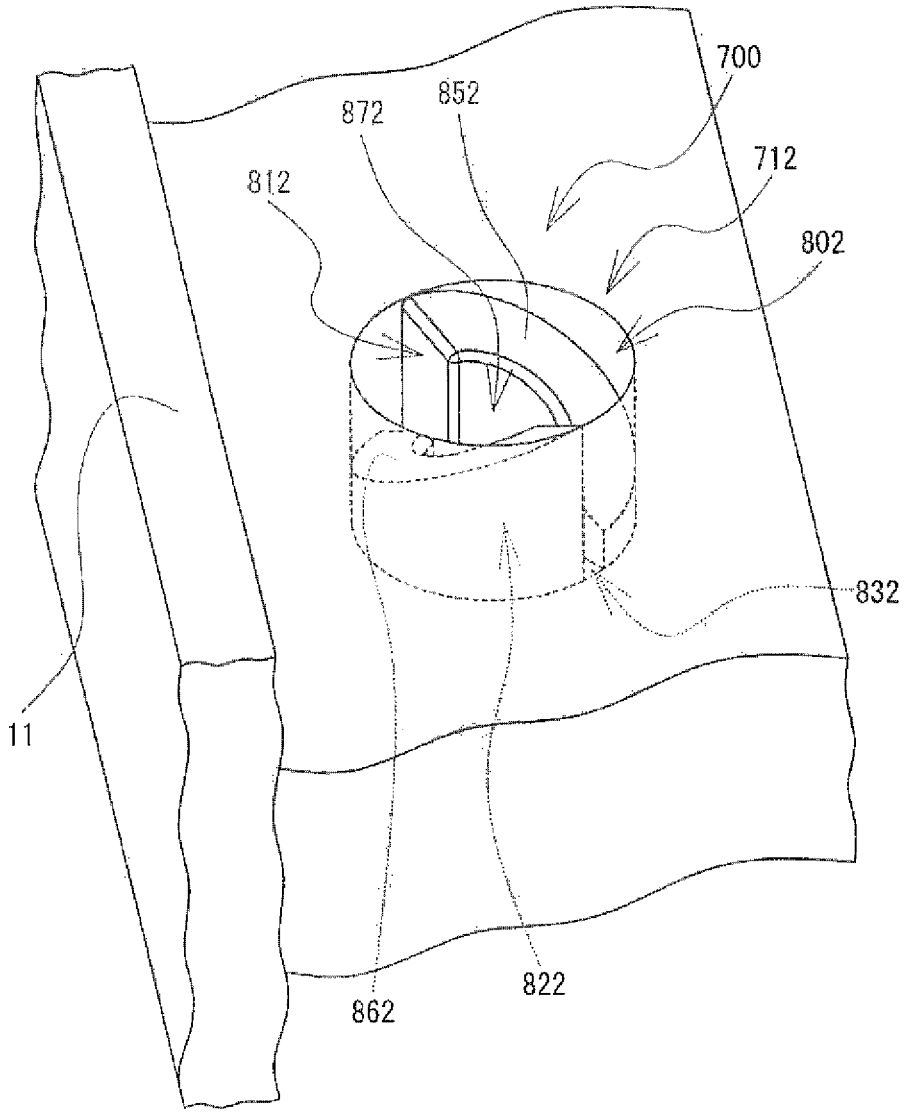
FIG. 18 is an example of a perspective view of a guide portion 712.

As described above, the shape of the guide portions 711, 713 and 714 shown in FIG. 17 is the same as that of the guide portion 712, and each of the guide portions 711, 713 and 714 is provided with a first insertion hole and a second insertion hole. Meanwhile, the angles at which respective first inclined portions, second inclined portions and groove portions of the guide portions 711, 713 and 714 are provided are different in a plan view. The extending direction angle of groove portions 831 of the guide portion 711 is 0 degrees. The extending direction angle of groove portions 833 of the guide portion 713 is 90 degrees. The extending direction angle of groove portions 834 of the guide portion 714 is 135 degrees. The angle at which each of the inclined surfaces is provided is also different, in accordance with the angle of the groove portions. Note that, in FIG. 17, the reference numerals of the structural members of the guide portions 711, 713 and 714 are assigned in accordance with the reference numerals of the structural members of the guide portion 712.

Next, guide portion number data 300 will be explained with reference to FIG. 19. The guide portion number data 300 is stored in a guide portion number data storage area (not shown in the drawings) of the flash memory 64. The guide portion number data 300 is data that is referred to by the CPU 151 in second cutting needle rotation processing that will be explained later. The guide portion number data 300 includes the cutting needle angle data, a guide portion number K, X coordinate data and Y coordinate data, and each of the data items are stored in association with each other. The guide portion number K is data indicating the guide portions 711 to 714. The guide portion number K "1" corresponds to the guide portion 711, the guide portion number K "2" corresponds to the guide portion 712, the guide portion number K "3" corresponds to the guide portion 713, and the guide portion number K "4" corresponds to the guide portion 714. A value that is equal to the extending direction angle of the groove portions of the guide portion associated with the guide portion number K is stored in the cutting needle angle data. Among the guide portion 711 to 714, the X coordinate data and the Y coordinate data indicate a coordinate position of the embroidery frame 10 at which a central position of the first insertion hole of the guide portion associated with the guide portion number K is the needle drop point.

Cutwork execution processing that is performed by the CPU 151 of the sewing machine 2 will be explained with reference to FIG. 11 and FIG. 20. The cutwork execution processing performed by the sewing machine 2 is the same as that performed by the sewing machine 1 except that the first cutting needle rotation processing performed by the CPU 151 of the sewing machine 1 at step S15 is replaced by the second cutting needle rotation processing performed by the CPU 151 of the sewing machine 2 at step S15. In the following explanation, the second cutting needle rotation processing will be explained for a case in which the needle drop number N is "2." The second cutting needle rotation processing is processing to match the cutting needle angle data stored in association with the needle drop number N in the cutwork pattern data 100 (refer to FIG. 7) with the cutting needle angle of the cutting needle 8.

Figure 20:
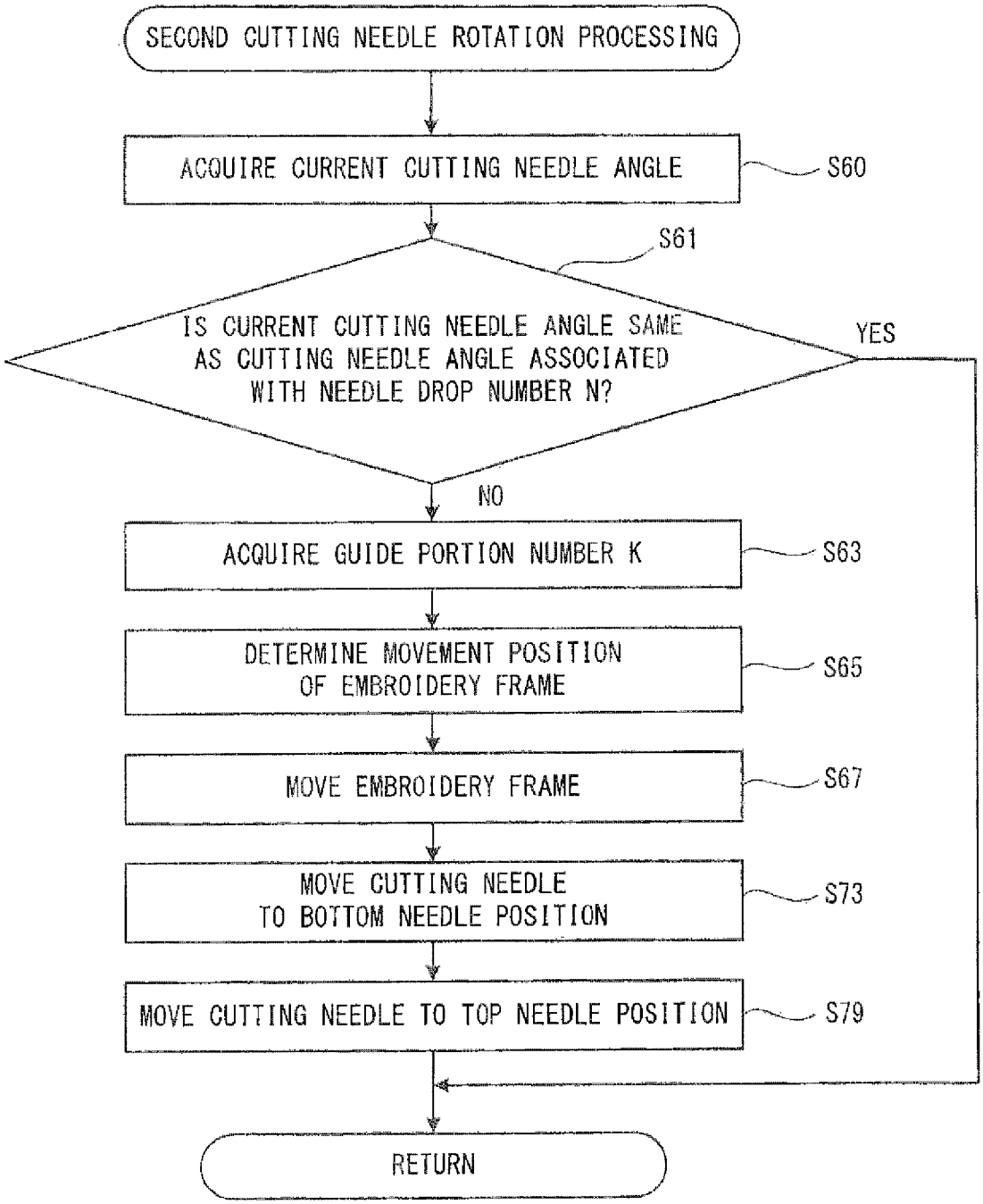
FIG. 20 is an example of a flowchart of second cutting needle rotation processing.

As shown in FIG. 20, in the second cutting needle rotation processing, first the CPU 151 acquires the current cutting needle angle of the cutting needle 8 (step S60). The CPU 151 refers to the cutting needle angle storage area 643 (refer to FIG. 6) of the flash memory 64 and acquires the stored cutting needle angle. The CPU 151 determines whether the current cutting needle angle is the same as the cutting needle angle associated with the needle drop number N in the cutwork pattern data 100 (refer to FIG. 7) (step S61). The CPU 151 refers to the cutwork pattern data 100 stored in the cutwork data storage area 641 (refer to FIG. 6) of the flash memory 64 and acquires the cutting needle angle associated with the needle drop number N, then compares it with the current cutting needle angle acquired at step S30. When the current cutting needle angle and the cutting needle angle associated with the needle drop number N are the same (yes at step S61), the CPU 151 ends the second cutting needle rotation processing and returns the processing to the cutwork execution processing (refer to FIG. 11).

For example, when the cutting needle angle data acquired from the flash memory 64 is "0 degrees" (step S60) and the needle drop number N is "1," the cutting needle angle data stored in the cutwork pattern data 100 is also "0 degrees" (yes at step S61). In this case, the second cutting needle rotation processing is ended.

When the current cutting needle angle and the cutting needle angle associated with the needle drop number N are different (no at step S61), after acquiring the guide portion number K (step S63), the CPU 151 sets the movement position of the embroidery frame 10 (step S65). The CPU 151 refers to the guide portion number data 300 stored in the guide portion number data storage area (not shown in the drawings) of the flash memory 64, and acquires the guide portion number K that is associated with the cutting needle angle data that is the same as the cutting needle angle acquired at step S60. Then, the CPU 151 refers to the guide portion number data 300 and acquires the coordinate data of the embroidery frame 10 associated with the acquired guide portion number K, then sets the movement position of the embroidery frame 10 (step S65). The set movement position is stored in the RAM 153. Next, the CPU 151 controls the drive circuits 74 and 75 and drives the X axis motor 82 and the Y axis motor 83, thus moving the embroidery frame 10 toward the coordinate position set at step S65 (step S67).

When the needle drop number N is "2," for example, the cutting needle angle data associated with the needle drop number N "2" in the cutwork pattern data 100 is "45 degrees," which is different to the current cutting needle angle (no at step S61). Thus, the CPU 151 acquires, from the guide portion number data 300, the guide portion number K "2" that is associated with the cutting needle angle data "45 degrees" (step S63). When the guide portion number K is "2," the X coordinate data of the embroidery frame 10 is "u2" and the Y coordinate data is "v2." For the movement position of the embroidery frame 10, the CPU 151 sets the X coordinate data to "u2" and the Y coordinate data to "v2" (step S65). Then, the CPU 151 moves the embroidery frame 10 to the set position (step S67). Through the above-described processing, the movement position of the embroidery frame 10 is determined and the embroidery frame 10 is moved such that the protruding portion 621 can fit with the guide portion 712, which is associated with the guide portion number K "2."

Next, the CPU 151 controls the drive circuit 71 and drives the sewing machine motor 79, thus lowering the needle bar 6 (namely, the cutting needle 8) from the top needle position to a bottom needle position (step S73). More specifically, the CPU 151 rotates the drive shaft 72 by 180 degrees, based on a signal output from the encoder 77. Here, the bottom needle position refers to a lowest position in the movement range of the needle bar 6 in the up-down direction.

Figure 21:
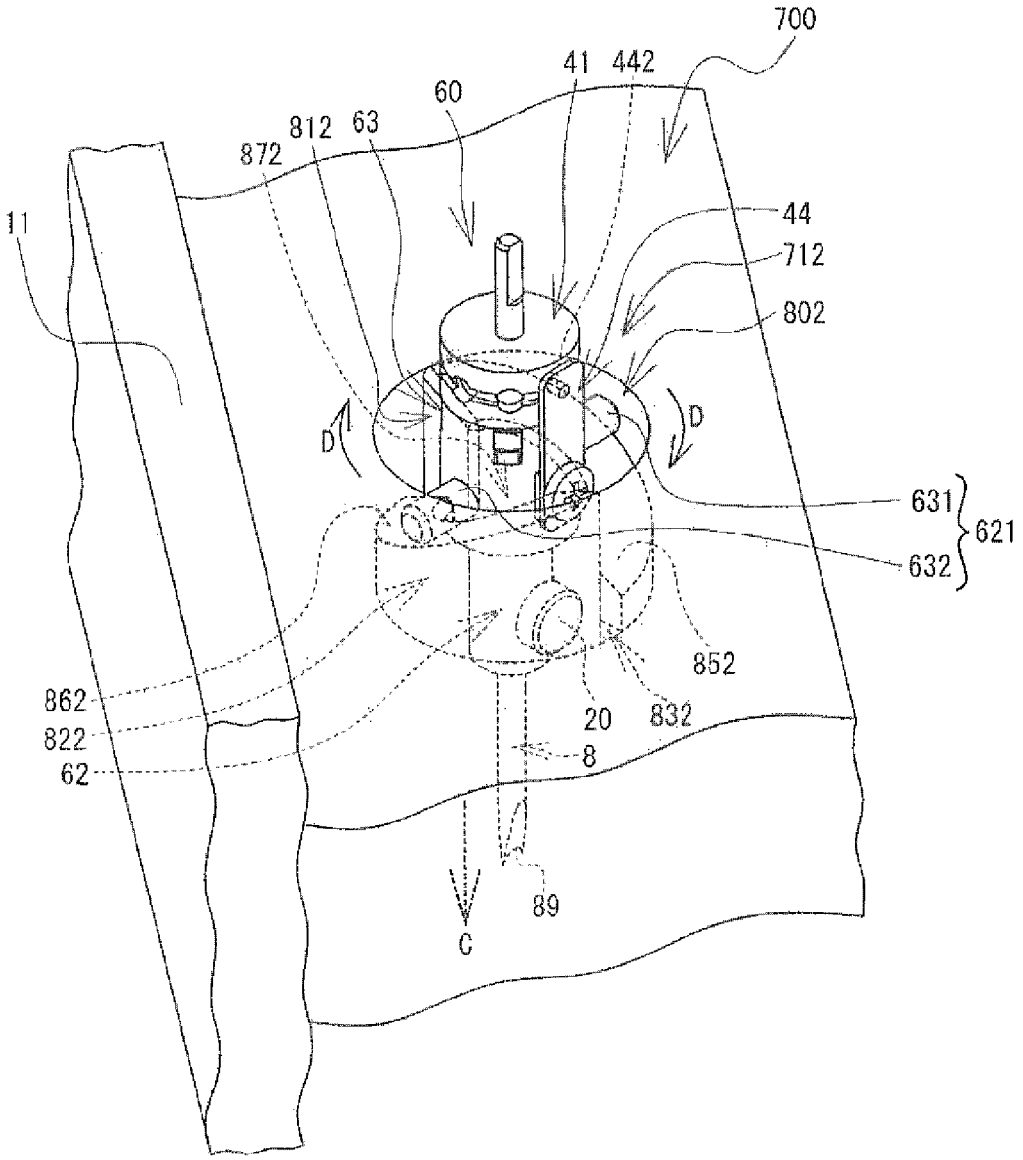
FIG. 21 is an example of a perspective view of a case in which a protruding portion 621 is guided by the guide portion 712.

When the cutting needle 8 is moved from the top needle position to the bottom needle position, as shown in FIG. 21, when the cutting needle rotation mechanism 60 is lowered in the direction of an arrow C toward the guide portion 712, the first protruding portion 631 comes into contact with the first guide surface 852 and the second protruding portion 632 comes into contact with the second guide surface 862. When the cutting needle rotation mechanism 60 is then lowered further, the first protruding portion 631 is guided along the first guide surface 852 and the second protruding portion 632 is guided along the second guide surface 862 in the clockwise direction (the direction of an arrow D) in a plan view. Thus, the protruding portion 621 rotates in the clockwise direction in a plan view and finally fits into the groove portions 832.

In accordance with the rotation of the protruding portion 621, the rotation member 63, the holding member 62 and the plate spring 44 also rotate integrally in the clockwise direction in the plan view. When the plate spring 44 rotates, the engagement portion 442 resists the urging force imparted by the plate spring 44, is displaced from the engagement receiving portion 414 with which it was engaged, and moves along the groove portion 415 while rotating in the clockwise direction in a plan view. The engagement portion 442 moves along the groove portion 415 while rotating in the clockwise direction (the direction of the arrow D) in the plan view. The engagement portion 442 engages with the engagement receiving portion 414 that is adjacent to the engagement receiving portion 414 with which it was hitherto engaged (hereinafter referred to as the adjacent engagement receiving portion 414). Due to the above-described structure, the plate spring 44 once more urges the support member 41, in the direction in which the engagement portion 442 engages with the adjacent engagement receiving portion 414 (the direction toward the axial line of the support member 41). By this urging, the rotation of the rotation member 63 is locked. Through the above-described processing, the cutting needle angle of the cutting needle 8 becomes 45 degrees, which is the same as the extending direction angle of the groove portions 832.

Next, the CPU 151 controls the drive circuit 71 and drives the sewing machine motor 79, thus raising the needle bar 6 (namely, the cutting needle 8) from the bottom needle position to the top needle position (step S79). More specifically, the CPU 151 rotates the drive shaft 72 by 180 degrees, based on a signal output from the encoder 77.

In the above explanation, the case is explained in which the needle drop number N is "2," but the processing is performed in the same manner when the needle drop number N is "3," "4," or "CUT_END" etc. As shown in FIG. 7, the cutting needle angle data that is associated with the needle drop number N "3," "4," and "CUT_END" in the cutwork pattern data 100 is, respectively, "135 degrees," "90 degrees" and "0 degrees." In this case, as shown in the guide portion number data 300 shown in FIG. 19, the guide portion numbers K associated with the cutting needle angles "135 degrees," "90 degrees" and "0 degrees" are, respectively, "4," "3" and "1." Thus, when the needle drop number N is "4," "3" and "CUT_END," the cutting needle 8 and the rotation member 63 are guided, respectively, by the guide portions 714, 713 and 711 and the cutting needle angle is thus adjusted.

As explained above, after the embroidery frame 10 is moved to the position determined at step S65, the cutting needle 8 is lowered and thus the protruding portion 621 is guided by the first guide surface and the second guide surface of one of the guide portions 711 to 714. The protruding portion 621 is rotated while being lowered to the position at which it fits with the groove portions 831 to 834 of the guide portions 711 to 714. As a result; the sewing machine 2 can automatically rotate the cutting needle 8. Further, the protruding portion 621 is guided by one of the first guide surfaces 851 to 854 and one of the second guide surfaces 861 to 864 of the guide portions 711 to 714, and thus the protruding portion 621 rotates in a stable manner. The sewing machine 2 can therefore rotate the cutting needle 8 in a stable manner.

Furthermore, the first guide surfaces 851 to 854 and the second guide surfaces 861 to 864 of each of the guide portions 711 to 714 are inclined downward along the circumferential direction of the insertion hole provided in each of the guide portions 711 to 714. Further, the respective groove portions 831 to 834 of the guide portions 711 to 714 are connected to the lower ends of the first guide surfaces 851 to 854 and the second guide surfaces 861 to 864 of the guide portions 711 to 714. Therefore, the protruding portion 621 that is guided by the first guide surfaces 851 to 854 and the second guide surfaces 861 to 864 of the guide portions 711 to 714 easily rotates while being lowered, and the rotation stops at the position at which the protruding portion 621 fits with the groove portions. The cutting needle angle of the cutting needle 8 becomes the same as the extending direction angle of the groove portions 831 to 834 of each of the guide portions 711 to 714. Thus, the sewing machine 2 can rotate the cutting needle 8 in a more stable manner and can also improve the accuracy of the set cutting needle angle of the cutting needle 8.

The first guide surfaces 851 to 854, the second guide surfaces 861 to 864 and the two groove portions of each of the guide portions 711 to 714 are provided such that they are symmetrical with respect to the axial line of the first insertion hole of each of the guide portions 711 to 714. The protruding portion 621 is provided such that it is symmetrical, centering on the axial line of the rotation member 63. Thus, when the cutting needle 8 and the rotation member 63 are inserted into the first insertion hole of one of the guide portions 711 to 714, the first protruding portion 631 and the second protruding portion 632 are guided by one of the first guide surfaces 851 to 854 and one of the second guide surfaces 861 to 864 of the guide portions 711 to 714. As a result, the sewing machine 2 can rotate the cutting needle 8 in an even more stable manner, compared to a case in which only one end of the protruding portion 621 is guided.

Further, by the engagement portion 442 of the plate spring 44 being engaged with one of the plurality of engagement receiving portion 414, the plate spring 44 urges the support portion 41 in the direction in which the engagement portion 442 engages with the engagement receiving portion 414. By this urging, the rotation of the rotation member 63 is locked and the rotation of the cutting needle 8 is also locked. The sewing machine 2 can inhibit the cutting needle 8 from rotating unnecessarily when performing the cutwork on the work cloth. As a result, the sewing machine 2 can perform the cutwork on the work cloth in a stable manner.

It should be noted that the present disclosure is not limited to the above-described embodiment and various modifications are possible. For example, in the above-described embodiment, the support portion 700 is formed integrally with the right side portion of the outer frame 11. In place of the above-described structure, the support portion 700 may be a separate member from the outer frame 11 and may be fixed to the right side portion of the outer frame 11 by a screw or by adhesive.

In the above-described embodiment, the support portion 700 is provided with the four guide portions 711 to 714 whose extending direction angles differ by 45 degrees, respectively. In place of the above-described structure, six guide portions may be provided whose extending direction angles differ by 30 degrees, respectively. In this case, the angle of the cutting blade of the cutting needle 8 can be adjusted at 30 degree intervals. Further, each of the shape, the size, the number and the extending direction angle of the guide portion may be changed as appropriate.

In the above-described embodiment, the protruding portion 621 is a shaft member that penetrates through the rotation member 63. In place of the above-described structure, the protruding portion may be formed integrally with the rotation member 63.

What is claimed is:

1. A sewing machine comprising:

a needle bar driving mechanism configured to move a needle bar in a first direction;

an embroidery frame movement mechanism configured to receive an embroidery frame, and configured to move the embroidery frame along a second direction crossing the first direction, wherein the embroidery frame comprises a protruding portion that protrudes outward from the embroidery frame;

a cutting needle rotation mechanism comprising:

a cutting needle;

a cam member to which the cutting needle is fixed, and the cam member being rotatable around an axial line of the needle bar, and comprising a plurality of cams, the plurality of cams being arranged in mutually adjacent positions therebetween in the first direction, each of the plurality of cams comprising a cam surface portion that comprises a width in the first direction and a support mechanism configured to support the cam member on the needle bar rotatably;

a processor; and a memory configured to store computer-readable instructions that cause the sewing machine to:

set a height of the needle bar to a specific position from a plurality of positions, each of the plurality of positions representing that each of the plurality of cams is able to contact the protruding portion;

instruct the needle bar driving mechanism to move the needle bar to the specific position; and instruct the embroidery frame movement mechanism to move the embroidery frame along the second direction to a predetermined position where the protruding portion is able to contact one of the plurality of cams.

2. The sewing machine according to claim 1, wherein the cam surface portion of each of the plurality cams is arranged along a rotational direction of the plurality of cams at a specific distance between each of the plurality of cams.

3. The sewing machine according to claim 1, wherein the support mechanism comprises:

a support member configured to be detachably mounted on the needle bar, the support member comprising a plurality of engagement portions disposed on the support member at a specific distance along a rotational direction of the plurality of cams, a fixing member to which the cam member is fixed, and an elastic member having an urging force between the fixing member and the support member, one end side of the elastic member being configured to engage with any one of the plurality of engagement portions, and another end side of the elastic member being fixed on the fixing member.

4. A sewing machine comprising:

a needle bar driving mechanism configured to move a needle bar in a first direction;

an embroidery frame movement mechanism configured to receive an embroidery frame and configured to move the embroidery frame along a second direction and a third direction crossing the first direction, wherein the embroidery frame comprises a plurality of protruding portions, each of the plurality of protruding portions being disposed on the embroidery frame along the third direction, each of the plurality of protruding portions protruding outward from the embroidery frame;

a cutting needle rotation mechanism comprising:

a cutting needle;

a cam member to which the cutting needle is fixed, and the cam member being rotatable around an axial line of the needle bar, and comprising a plurality of cams, the plurality of cams being arranged in mutually adjacent positions therebetween in the first direction, each of the plurality of cams comprising a cam surface portion that comprises a width in the first direction and a support mechanism configured to support the cam member on the needle bar rotatably;

a processor; and a memory configured to store computer-readable instructions that cause the sewing machine to: instruct the embroidery frame movement mechanism to move the embroidery frame along the second direction and the third direction to a specific position where one of the plurality of protruding portions is able to contact one of the plurality of cams.

5. A sewing machine comprising:

a needle bar driving mechanism configured to move a needle bar in a first direction;

a cutting needle rotation mechanism comprising:

a cutting needle;

a base member comprising a protruding member protruding along a particular direction to be separated from the needle bar; and a support member configured to support the base member on the needle bar rotatably;

an embroidery frame movement mechanism configured to receive an embroidery frame and configured to move the embroidery frame along a second direction crossing the first direction, the embroidery frame comprising a plurality of guide portions, each of the plurality of guide portions configured to engage with the protruding member, a processor; and a memory configured to store computer-readable instructions that cause the sewing machine to:

set a specific position of the embroidery frame to a predetermined position from a plurality of positions, each of the plurality of positions representing that each of the plurality of guide portions is able to engage with the protruding member;

instruct the embroidery frame movement mechanism to move the embroidery frame to the specific position; and instruct the needle bar driving mechanism to move the needle bar in the first direction.

6. The sewing machine according to claim 5, wherein each of the plurality of guide portions comprises:

an insertion hole configured to allow the cutting needle and the base member to be inserted, and a guide surface inclined downward along a circumferential direction of the insertion hole.

7. The sewing machine according to claim 6, wherein the protruding member comprises:

a first protruding portion protruding along a first particular direction to be separated from the needle bar; and a second protruding portion protruding along a second particular direction to be separated from the needle bar, wherein the first particular direction and the second particular direction are opposite directions, and the guide surface comprises:

a first guide surface configured to guide the first protruding portion; and a second guide surface configured to guide the second protruding portion.

8. The sewing machine according to claim 5, wherein the support member is configured to be detachably mounted on the needle bar, and the support member comprises:

a plurality of engagement portions disposed on the support member at a specific distance along a rotational direction of the axial line of the needle bar, and an elastic member having an urging force between the base member and the support member, one end side of the elastic member is configured to engage with any one of the plurality of engagement, and another end side of the elastic member is fixed on the base member.

* * * * *